US010293624B2

(12) United States Patent
Wong et al.

(10) Patent No.: US 10,293,624 B2
(45) Date of Patent: May 21, 2019

(54) SMART MEDIA HANGER WITH MEDIA WIDTH DETECTION

(71) Applicant: Datamax-O'Neil Corporation, Orlando, FL (US)

(72) Inventors: Chin Young Wong, Singapore (SG); Boon Kheng Lim, Singapore (SG); Yaw Horng Yap, Singapore (SG); Sébastien Michel Marie Joseph d'Armancourt, Singapore (SG)

(73) Assignee: DATAMAX-O'NEIL CORPORATION, Orlando, FL (US)

( * ) Notice: Subject to any disclaimer, the term of this patent is extended or adjusted under 35 U.S.C. 154(b) by 0 days.

(21) Appl. No.: 15/790,645

(22) Filed: Oct. 23, 2017

(65) Prior Publication Data

US 2019/0118529 A1 Apr. 25, 2019

(51) Int. Cl.

| | |
|---|---|
| ***B41J 3/407*** | (2006.01) |
| ***B41J 15/04*** | (2006.01) |
| ***B41J 2/32*** | (2006.01) |
| ***B41F 33/16*** | (2006.01) |
| ***B41F 21/00*** | (2006.01) |

(52) U.S. Cl.

CPC ..... *B41J 15/04* (2013.01); *B41F 21/00* (2013.01); *B41F 33/16* (2013.01); *B41J 3/4075* (2013.01); *B41J 2/32* (2013.01)

(58) Field of Classification Search

CPC ..... B41F 33/16; B41F 21/00; B41J 3/4075; B41J 15/04; B41J 2/32

See application file for complete search history.

(56) References Cited

U.S. PATENT DOCUMENTS

| | | | |
|---|---|---|---|
| 5,396,313 | A | 3/1995 | Zoltner et al. |
| 6,201,255 | B1 | 3/2001 | Torchalski et al. |
| 6,832,725 | B2 | 12/2004 | Gardiner et al. |
| 7,128,266 | B2 | 10/2006 | Zhu et al. |
| 7,159,783 | B2 | 1/2007 | Walczyk et al. |
| 7,413,127 | B2 | 8/2008 | Ehrhart et al. |

(Continued)

FOREIGN PATENT DOCUMENTS

WO 2013163789 A1 11/2013

OTHER PUBLICATIONS

Datamax-O'Neil Corporation, "Performance Series User's Guide", copyrighted 2015, 145 pages.

*Primary Examiner* — Kristal Feggins
*Assistant Examiner* — Kendrick X Liu
(74) *Attorney, Agent, or Firm* — Additon, Higgins & Pendleton, P.A.

(57) ABSTRACT

The present invention embraces a method and apparatus for providing feedback to a user on the status of media or ribbon of a printer. The feedback may be provided by incorporating a feedback mechanism in a hanger of a printer. The printer may be a thermal printer, but may be another type of printer. The feedback mechanism of the printer may be designed to work with one or more sensors to provide a feedback loop so that without an input from a user, the printer is able to detect the presence/absence of media or ribbon, as well as determine the width of the loaded media or ribbon. In another embodiment, the feedback mechanism is able to determine the weight of the roll of media or ribbon and hence determine the quantity of media or ribbon available on the hanger.

11 Claims, 16 Drawing Sheets

(56) References Cited

U.S. PATENT DOCUMENTS 7,726,575 B2 6/2010 Wang et al.
7,845,632 B2 12/2010 Windsor et al.
8,265,836 B2 9/2012 Yamada et al.
8,276,468 B2 10/2012 McNamee et al.
8,294,969 B2 10/2012 Plesko
8,302,896 B2 11/2012 Iwasaki
8,317,105 B2 11/2012 Kotlarsky et al.
8,322,622 B2 12/2012 Liu
8,366,005 B2 2/2013 Kotlarsky et al.
8,371,507 B2 2/2013 Haggerty et al.
8,376,233 B2 2/2013 Horn et al.
8,381,979 B2 2/2013 Franz
8,390,909 B2 3/2013 Plesko
8,408,464 B2 4/2013 Zhu et al.
8,408,468 B2 4/2013 Horn et al.
8,408,469 B2 4/2013 Good
8,424,768 B2 4/2013 Rueblinger et al.
8,448,863 B2 5/2013 Xian et al.
8,457,013 B2 6/2013 Essinger et al.
8,459,557 B2 6/2013 Havens et al.
8,469,272 B2 6/2013 Kearney
8,474,712 B2 7/2013 Kearney et al.
8,479,992 B2 7/2013 Kotlarsky et al.
8,490,877 B2 7/2013 Kearney
8,517,271 B2 8/2013 Kotlarsky et al.
8,523,076 B2 9/2013 Good
8,528,818 B2 9/2013 Ehrhart et al.
8,544,737 B2 10/2013 Gomez et al.
8,548,420 B2 10/2013 Grunow et al.
8,550,335 B2 10/2013 Samek et al.
8,550,354 B2 10/2013 Gannon et al.
8,550,357 B2 10/2013 Kearney
8,556,174 B2 10/2013 Kosecki et al.
8,556,176 B2 10/2013 Van Horn et al.
8,556,177 B2 10/2013 Hussey et al.
8,559,767 B2 10/2013 Barber et al.
8,561,895 B2 10/2013 Gomez et al.
8,561,903 B2 10/2013 Sauerwein
8,561,905 B2 10/2013 Edmonds et al.
8,565,107 B2 10/2013 Pease et al.
8,571,307 B2 10/2013 Li et al.
8,579,200 B2 11/2013 Samek et al.
8,583,924 B2 11/2013 Caballero et al.
8,584,945 B2 11/2013 Wang et al.
8,587,595 B2 11/2013 Wang
8,587,697 B2 11/2013 Hussey et al.
8,588,869 B2 11/2013 Sauerwein et al.
8,590,789 B2 11/2013 Nahill et al.
8,596,539 B2 12/2013 Havens et al.
8,596,542 B2 12/2013 Havens et al.
8,596,543 B2 12/2013 Havens et al.
8,599,271 B2 12/2013 Havens et al.
8,599,957 B2 12/2013 Peake et al.
8,600,158 B2 12/2013 Li et al.
8,600,167 B2 12/2013 Showering
8,602,309 B2 12/2013 Longacre et al.
8,608,053 B2 12/2013 Meier et al.
8,608,071 B2 12/2013 Liu et al.
8,611,309 B2 12/2013 Wang et al.
8,615,487 B2 12/2013 Gomez et al.
8,621,123 B2 12/2013 Caballero
8,622,303 B2 1/2014 Meier et al.
8,628,013 B2 1/2014 Ding
8,628,015 B2 1/2014 Wang et al.
8,628,016 B2 1/2014 Winegar
8,629,926 B2 1/2014 Wang
8,630,491 B2 1/2014 Longacre et al.
8,635,309 B2 1/2014 Berthiaume et al.
8,636,200 B2 1/2014 Kearney
8,636,212 B2 1/2014 Nahill et al.
8,636,215 B2 1/2014 Ding et al.
8,636,224 B2 1/2014 Wang
8,638,806 B2 1/2014 Wang et al.
8,640,958 B2 2/2014 Lu et al.
8,640,960 B2 2/2014 Wang et al.
8,643,717 B2 2/2014 Li et al.
8,646,692 B2 2/2014 Meier et al.
8,646,694 B2 2/2014 Wang et al.
8,657,200 B2 2/2014 Ren et al.
8,659,397 B2 2/2014 Vargo et al.
8,668,149 B2 3/2014 Good
8,678,285 B2 3/2014 Kearney
8,678,286 B2 3/2014 Smith et al.
8,682,077 B1 3/2014 Longacre
D702,237 S 4/2014 Oberpriller et al.
8,687,282 B2 4/2014 Feng et al.
8,692,927 B2 4/2014 Pease et al.
8,695,880 B2 4/2014 Bremer et al.
8,698,949 B2 4/2014 Grunow et al.
8,702,000 B2 4/2014 Barber et al.
8,717,494 B2 5/2014 Gannon
8,720,783 B2 5/2014 Biss et al.
8,723,804 B2 5/2014 Fletcher et al.
8,723,904 B2 5/2014 Marty et al.
8,727,223 B2 5/2014 Wang
8,740,082 B2 6/2014 Wilz
8,740,085 B2 6/2014 Furlong et al.
8,746,563 B2 6/2014 Hennick et al.
8,750,445 B2 6/2014 Peake et al.
8,752,766 B2 6/2014 Xian et al.
8,756,059 B2 6/2014 Braho et al.
8,757,495 B2 6/2014 Qu et al.
8,760,563 B2 6/2014 Koziol et al.
8,763,909 B2 7/2014 Reed
8,777,108 B2 7/2014 Coyle
8,777,109 B2 7/2014 Oberpriller et al.
8,779,898 B2 7/2014 Havens et al.
8,781,520 B2 7/2014 Payne et al.
8,783,573 B2 7/2014 Havens et al.
8,789,757 B2 7/2014 Barten
8,789,758 B2 7/2014 Hawley et al.
8,789,759 B2 7/2014 Xian et al.
8,794,520 B2 8/2014 Wang et al.
8,794,522 B2 8/2014 Ehrhart
8,794,525 B2 8/2014 Amundsen et al.
8,794,526 B2 8/2014 Wang et al.
8,798,367 B2 8/2014 Ellis
8,807,431 B2 8/2014 Wang et al.
8,807,432 B2 8/2014 Van Horn et al.
8,820,630 B2 9/2014 Qu et al.
8,822,848 B2 9/2014 Meagher
8,824,692 B2 9/2014 Sheerin et al.
8,824,696 B2 9/2014 Braho
8,842,849 B2 9/2014 Wahl et al.
8,844,822 B2 9/2014 Kotlarsky et al.
8,844,823 B2 9/2014 Fritz et al.
8,849,019 B2 9/2014 Li et al.
D716,285 S 10/2014 Chaney et al.
8,851,383 B2 10/2014 Yeakley et al.
8,854,633 B2 10/2014 Laffargue
8,866,963 B2 10/2014 Grunow et al.
8,868,421 B2 10/2014 Braho et al.
8,868,519 B2 10/2014 Maloy et al.
8,868,802 B2 10/2014 Barten
8,868,803 B2 10/2014 Caballero
8,870,074 B1 10/2014 Gannon
8,879,639 B2 11/2014 Sauerwein
8,880,426 B2 11/2014 Smith
8,881,983 B2 11/2014 Havens et al.
8,881,987 B2 11/2014 Wang
8,903,172 B2 12/2014 Smith
8,908,995 B2 12/2014 Benos et al.
8,910,870 B2 12/2014 Li et al.
8,910,875 B2 12/2014 Ren et al.
8,914,290 B2 12/2014 Hendrickson et al.
8,914,788 B2 12/2014 Pettinelli et al.
8,915,439 B2 12/2014 Feng et al.
8,915,444 B2 12/2014 Havens et al.
8,916,789 B2 12/2014 Woodburn
8,918,250 B2 12/2014 Hollifield
8,918,564 B2 12/2014 Caballero
8,925,818 B2 1/2015 Kosecki et al.
8,939,374 B2 1/2015 Jovanovski et al.
8,942,480 B2 1/2015 Ellis

(56) References Cited

U.S. PATENT DOCUMENTS

| | | | |
|---|---|---|---|
| 8,944,313 | B2 | 2/2015 | Williams et al. |
| 8,944,327 | B2 | 2/2015 | Meier et al. |
| 8,944,332 | B2 | 2/2015 | Harding et al. |
| 8,950,678 | B2 | 2/2015 | Germaine et al. |
| D723,560 | S | 3/2015 | Zhou et al. |
| 8,967,468 | B2 | 3/2015 | Gomez et al. |
| 8,971,346 | B2 | 3/2015 | Sevier |
| 8,976,030 | B2 | 3/2015 | Cunningham et al. |
| 8,976,368 | B2 | 3/2015 | Akel et al. |
| 8,978,981 | B2 | 3/2015 | Guan |
| 8,978,983 | B2 | 3/2015 | Bremer et al. |
| 8,978,984 | B2 | 3/2015 | Hennick et al. |
| 8,985,456 | B2 | 3/2015 | Zhu et al. |
| 8,985,457 | B2 | 3/2015 | Soule et al. |
| 8,985,459 | B2 | 3/2015 | Kearney et al. |
| 8,985,461 | B2 | 3/2015 | Gelay et al. |
| 8,988,578 | B2 | 3/2015 | Showering |
| 8,988,590 | B2 | 3/2015 | Gillet et al. |
| 8,991,704 | B2 | 3/2015 | Hopper et al. |
| 8,996,194 | B2 | 3/2015 | Davis et al. |
| 8,996,384 | B2 | 3/2015 | Funyak et al. |
| 8,998,091 | B2 | 4/2015 | Edmonds et al. |
| 9,002,641 | B2 | 4/2015 | Showering |
| 9,007,368 | B2 | 4/2015 | Laffargue et al. |
| 9,010,641 | B2 | 4/2015 | Qu et al. |
| 9,015,513 | B2 | 4/2015 | Murawski et al. |
| 9,016,576 | B2 | 4/2015 | Brady et al. |
| D730,357 | S | 5/2015 | Fitch et al. |
| 9,022,288 | B2 | 5/2015 | Nahill et al. |
| 9,030,964 | B2 | 5/2015 | Essinger et al. |
| 9,033,240 | B2 | 5/2015 | Smith et al. |
| 9,033,242 | B2 | 5/2015 | Gillet et al. |
| 9,036,054 | B2 | 5/2015 | Koziol et al. |
| 9,037,344 | B2 | 5/2015 | Chamberlin |
| 9,038,911 | B2 | 5/2015 | Xian et al. |
| 9,038,915 | B2 | 5/2015 | Smith |
| D730,901 | S | 6/2015 | Oberpriller et al. |
| D730,902 | S | 6/2015 | Fitch et al. |
| 9,047,098 | B2 | 6/2015 | Barten |
| 9,047,359 | B2 | 6/2015 | Caballero et al. |
| 9,047,420 | B2 | 6/2015 | Caballero |
| 9,047,525 | B2 | 6/2015 | Barber |
| 9,047,531 | B2 | 6/2015 | Showering et al. |
| 9,049,640 | B2 | 6/2015 | Wang et al. |
| 9,053,055 | B2 | 6/2015 | Caballero |
| 9,053,378 | B1 | 6/2015 | Hou et al. |
| 9,053,380 | B2 | 6/2015 | Xian et al. |
| 9,057,641 | B2 | 6/2015 | Amundsen et al. |
| 9,058,526 | B2 | 6/2015 | Powilleit |
| 9,061,527 | B2 | 6/2015 | Tobin et al. |
| 9,064,165 | B2 | 6/2015 | Havens et al. |
| 9,064,167 | B2 | 6/2015 | Xian et al. |
| 9,064,168 | B2 | 6/2015 | Todeschini et al. |
| 9,064,254 | B2 | 6/2015 | Todeschini et al. |
| 9,066,032 | B2 | 6/2015 | Wang |
| 9,070,032 | B2 | 6/2015 | Corcoran |
| D734,339 | S | 7/2015 | Zhou et al. |
| D734,751 | S | 7/2015 | Oberpriller et al. |
| 9,076,459 | B2 | 7/2015 | Braho et al. |
| 9,079,423 | B2 | 7/2015 | Bouverie et al. |
| 9,080,856 | B2 | 7/2015 | Laffargue |
| 9,082,023 | B2 | 7/2015 | Feng et al. |
| 9,084,032 | B2 | 7/2015 | Rautiola et al. |
| 9,087,250 | B2 | 7/2015 | Coyle |
| 9,092,681 | B2 | 7/2015 | Havens et al. |
| 9,092,682 | B2 | 7/2015 | Wilz et al. |
| 9,092,683 | B2 | 7/2015 | Koziol et al. |
| 9,093,141 | B2 | 7/2015 | Liu |
| 9,098,763 | B2 | 8/2015 | Lu et al. |
| 9,104,929 | B2 | 8/2015 | Todeschini |
| 9,104,934 | B2 | 8/2015 | Li et al. |
| 9,107,484 | B2 | 8/2015 | Chaney |
| 9,111,159 | B2 | 8/2015 | Liu et al. |
| 9,111,166 | B2 | 8/2015 | Cunningham |
| 9,135,483 | B2 | 9/2015 | Liu et al. |
| 9,137,009 | B1 | 9/2015 | Gardiner |
| 9,141,839 | B2 | 9/2015 | Xian et al. |
| 9,147,096 | B2 | 9/2015 | Wang |
| 9,148,474 | B2 | 9/2015 | Skvoretz |
| 9,158,000 | B2 | 10/2015 | Sauerwein |
| 9,158,340 | B2 | 10/2015 | Reed et al. |
| 9,158,953 | B2 | 10/2015 | Gillet et al. |
| 9,159,059 | B2 | 10/2015 | Daddabbo et al. |
| 9,165,174 | B2 | 10/2015 | Huck |
| 9,171,543 | B2 | 10/2015 | Emerick et al. |
| 9,183,425 | B2 | 11/2015 | Wang |
| 9,189,669 | B2 | 11/2015 | Zhu et al. |
| 9,195,844 | B2 | 11/2015 | Todesch Ini et al. |
| 9,202,458 | B2 | 12/2015 | Braho et al. |
| 9,208,366 | B2 | 12/2015 | Liu |
| 9,208,367 | B2 | 12/2015 | Wangu |
| 9,219,836 | B2 | 12/2015 | Bouverie et al. |
| 9,224,022 | B2 | 12/2015 | Ackley et al. |
| 9,224,024 | B2 | 12/2015 | Bremer et al. |
| 9,224,027 | B2 | 12/2015 | Van Horn et al. |
| D747,321 | S | 1/2016 | London et al. |
| 9,230,140 | B1 | 1/2016 | Ackley |
| 9,235,553 | B2 | 1/2016 | Fitch et al. |
| 9,239,950 | B2 | 1/2016 | Fletcher |
| 9,245,492 | B2 | 1/2016 | Ackley et al. |
| 9,443,123 | B2 | 1/2016 | Hejl |
| 9,248,640 | B2 | 2/2016 | Heng |
| 9,250,652 | B2 | 2/2016 | London et al. |
| 9,250,712 | B1 | 2/2016 | Todeschini |
| 9,251,411 | B2 | 2/2016 | Todeschini |
| 9,258,033 | B2 | 2/2016 | Showering |
| 9,262,633 | B1 | 2/2016 | Todeschini et al. |
| 9,262,660 | B2 | 2/2016 | Lu et al. |
| 9,262,662 | B2 | 2/2016 | Chen |
| 9,269,036 | B2 | 2/2016 | Bremer |
| 9,270,782 | B2 | 2/2016 | Hala et al. |
| 9,274,812 | B2 | 3/2016 | Doren et al. |
| 9,275,388 | B2 | 3/2016 | Havens et al. |
| 9,277,668 | B2 | 3/2016 | Feng et al. |
| 9,280,693 | B2 | 3/2016 | Feng et al. |
| 9,286,496 | B2 | 3/2016 | Smith |
| 9,297,900 | B2 | 3/2016 | Jiang |
| 9,298,964 | B2 | 3/2016 | Li et al. |
| 9,301,427 | B2 | 3/2016 | Feng et al. |
| 9,304,376 | B2 | 4/2016 | Anderson |
| 9,310,609 | B2 | 4/2016 | Rueblinger et al. |
| 9,313,377 | B2 | 4/2016 | Todeschini et al. |
| 9,317,037 | B2 | 4/2016 | Byford et al. |
| D757,009 | S | 5/2016 | Oberpriller et al. |
| 9,342,723 | B2 | 5/2016 | Liu et al. |
| 9,342,724 | B2 | 5/2016 | McCloskey |
| 9,361,882 | B2 | 6/2016 | Ressler et al. |
| 9,365,381 | B2 | 6/2016 | Colonel et al. |
| 9,373,018 | B2 | 6/2016 | Colavito et al. |
| 9,375,945 | B1 | 6/2016 | Bowles |
| 9,378,403 | B2 | 6/2016 | Wang et al. |
| D760,719 | S | 7/2016 | Zhou et al. |
| 9,360,304 | B2 | 7/2016 | Chang et al. |
| 9,383,848 | B2 | 7/2016 | Daghigh |
| 9,384,374 | B2 | 7/2016 | Bianconi |
| 9,390,596 | B1 | 7/2016 | Todeschini |
| D762,604 | S | 8/2016 | Fitch et al. |
| 9,411,386 | B2 | 8/2016 | Sauerwein |
| 9,412,242 | B2 | 8/2016 | Van Horn et al. |
| 9,418,269 | B2 | 8/2016 | Havens et al. |
| 9,418,270 | B2 | 8/2016 | Van Volkinburg et al. |
| 9,423,318 | B2 | 8/2016 | Lui et al. |
| D766,244 | S | 9/2016 | Zhou et al. |
| 9,443,222 | B2 | 9/2016 | Singel et al. |
| 9,454,689 | B2 | 9/2016 | McCloskey et al. |
| 9,464,885 | B2 | 10/2016 | Lloyd et al. |
| 9,465,967 | B2 | 10/2016 | Xian et al. |
| 9,478,113 | B2 | 10/2016 | Xie et al. |
| 9,478,983 | B2 | 10/2016 | Kather et al. |
| D771,631 | S | 11/2016 | Fitch et al. |
| 9,481,186 | B2 | 11/2016 | Bouverie et al. |
| 9,488,986 | B1 | 11/2016 | Solanki |
| 9,489,782 | B2 | 11/2016 | Payne et al. |
| 9,490,540 | B1 | 11/2016 | Davies et al. |

(56) References Cited

U.S. PATENT DOCUMENTS 9,491,729 B2 11/2016 Rautiola et al.
9,497,092 B2 11/2016 Gomez et al.
9,507,974 B1 11/2016 Todeschini
9,519,814 B2 12/2016 Cudzilo
9,521,331 B2 12/2016 Bessettes et al.
9,530,038 B2 12/2016 Xian et al.
D777,166 S 1/2017 Bidwell et al.
9,558,386 B2 1/2017 Yeakley
9,572,901 B2 2/2017 Todeschini
9,606,581 B1 3/2017 Howe et al.
D783,601 S 4/2017 Schulte et al.
D785,617 S 5/2017 Bidwell et al.
D785,636 S 5/2017 Oberpriller et al.
9,646,189 B2 5/2017 Lu et al.
9,646,191 B2 5/2017 Unemyr et al.
9,652,648 B2 5/2017 Ackley et al.
9,652,653 B2 5/2017 Todeschini et al.
9,656,487 B2 5/2017 Ho et al.
9,659,198 B2 5/2017 Giordano et al.
D790,505 S 6/2017 Vargo et al.
D790,546 S 6/2017 Zhou et al.
9,680,282 B2 6/2017 Hanenburg
9,697,401 B2 7/2017 Feng et al.
9,701,140 B1 7/2017 Alaganchetty et al.
2007/0063048 A1 3/2007 Havens et al.
2009/0134221 A1 5/2009 Zhu et al.
2010/0177076 A1 7/2010 Essinger et al.
2010/0177080 A1 7/2010 Essinger et al.
2010/0177707 A1 7/2010 Essinger et al.
2010/0177749 A1 7/2010 Essinger et al.
2011/0169999 A1 7/2011 Grunow et al.
2011/0202554 A1 8/2011 Powilleit et al.
2012/0111946 A1 5/2012 Golant
2012/0168512 A1 7/2012 Kotlarsky et al.
2012/0193423 A1 8/2012 Samek
2012/0203647 A1 8/2012 Smith
2012/0223141 A1 9/2012 Good et al.
2012/0301202 A1 11/2012 Bouverie et al.
2013/0016368 A1* 1/2013 Bouverie ..... B41J 11/009 358/1.6
2013/0033556 A1 2/2013 Bouverie et al.
2013/0043312 A1 2/2013 Van Horn
2013/0075168 A1 3/2013 Amundsen et al.
2013/0126664 A1 5/2013 Hitz
2013/0175341 A1 7/2013 Kearney et al.
2013/0175343 A1 7/2013 Good
2013/0257744 A1 10/2013 Daghigh et al.
2013/0257759 A1 10/2013 Daghigh
2013/0270346 A1 10/2013 Xian et al.
2013/0292475 A1 11/2013 Kotlarsky et al.
2013/0292477 A1 11/2013 Hennick et al.
2013/0293539 A1 11/2013 Hunt et al.
2013/0293540 A1 11/2013 Laffargue et al.
2013/0306728 A1 11/2013 Thuries et al.
2013/0306731 A1 11/2013 Pedraro
2013/0307964 A1 11/2013 Bremer et al.
2013/0308625 A1 11/2013 Park et al.
2013/0313324 A1 11/2013 Koziol et al.
2013/0332524 A1 12/2013 Fiala et al.
2014/0001267 A1 1/2014 Giordano et al.
2014/0002828 A1 1/2014 Laffargue et al.
2014/0025584 A1 1/2014 Liu et al.
2014/0100813 A1 1/2014 Showering
2014/0034734 A1 2/2014 Sauerwein
2014/0039693 A1 2/2014 Havens et al.
2014/0049120 A1 2/2014 Kohtz et al.
2014/0049635 A1 2/2014 Laffargue et al.
2014/0061306 A1 3/2014 Wu et al.
2014/0063289 A1 3/2014 Hussey et al.
2014/0066136 A1 3/2014 Sauerwein et al.
2014/0067692 A1 3/2014 Ye et al.
2014/0070005 A1 3/2014 Nahill et al.
2014/0071840 A1 3/2014 Venancio
2014/0074746 A1 3/2014 Wang
2014/0076974 A1 3/2014 Havens et al.
2014/0078342 A1 3/2014 Li et al.
2014/0098792 A1 4/2014 Wang et al.
2014/0100774 A1 4/2014 Showering
2014/0103115 A1 4/2014 Meier et al.
2014/0104413 A1 4/2014 McCloskey et al.
2014/0104414 A1 4/2014 McCloskey et al.
2014/0104416 A1 4/2014 Giordano et al.
2014/0106725 A1 4/2014 Sauerwein
2014/0108010 A1 4/2014 Maltseff et al.
2014/0108402 A1 4/2014 Gomez et al.
2014/0108682 A1 4/2014 Caballero
2014/0110485 A1 4/2014 Toa et al.
2014/0114530 A1 4/2014 Fitch et al.
2014/0125853 A1 5/2014 Wang
2014/0125999 A1 5/2014 Longacre et al.
2014/0129378 A1 5/2014 Richardson
2014/0131443 A1 5/2014 Smith
2014/0131444 A1 5/2014 Wang
2014/0133379 A1 5/2014 Wang et al.
2014/0136208 A1 5/2014 Maltseff et al.
2014/0140585 A1 5/2014 Wang
2014/0152882 A1 6/2014 Samek et al.
2014/0158770 A1 6/2014 Sevier et al.
2014/0159869 A1 6/2014 Zumsteg et al.
2014/0166755 A1 6/2014 Liu et al.
2014/0166757 A1 6/2014 Smith
2014/0168787 A1 6/2014 Wang et al.
2014/0175165 A1 6/2014 Havens et al.
2014/0191913 A1 7/2014 Ge et al.
2014/0197239 A1 7/2014 Havens et al.
2014/0197304 A1 7/2014 Feng et al.
2014/0204268 A1 7/2014 Grunow et al.
2014/0214631 A1 7/2014 Hansen
2014/0217166 A1 8/2014 Berthiaume et al.
2014/0217180 A1 8/2014 Liu
2014/0231500 A1 8/2014 Ehrhart et al.
2014/0247315 A1 9/2014 Marty et al.
2014/0263493 A1 9/2014 Amurgis et al.
2014/0263645 A1 9/2014 Smith et al.
2014/0270196 A1 9/2014 Braho et al.
2014/0270229 A1 9/2014 Braho
2014/0278387 A1 9/2014 DiGregorio
2014/0282210 A1 9/2014 Bianconi
2014/0288933 A1 9/2014 Braho et al.
2014/0297058 A1 10/2014 Barker et al.
2014/0299665 A1 10/2014 Barber et al.
2014/0351317 A1 11/2014 Smith et al.
2014/0362184 A1 12/2014 Jovanovski et al.
2014/0363015 A1 12/2014 Braho
2014/0369511 A1 12/2014 Sheerin et al.
2014/0374483 A1 12/2014 Lu
2014/0374485 A1 12/2014 Xian et al.
2015/0001301 A1 1/2015 Ouyang
2015/0009338 A1 1/2015 Laffargue et al.
2015/0014416 A1 1/2015 Kotlarsky et al.
2015/0021397 A1 1/2015 Rueblinger et al.
2015/0028104 A1 1/2015 Ma et al.
2015/0029002 A1 1/2015 Yeakley et al.
2015/0032709 A1 1/2015 Maloy et al.
2015/0039309 A1 2/2015 Braho et al.
2015/0040378 A1 2/2015 Saber et al.
2015/0049347 A1 2/2015 Laffargue et al.
2015/0051992 A1 2/2015 Smith
2015/0053769 A1 2/2015 Thuries et al.
2015/0062366 A1 3/2015 Liu et al.
2015/0063215 A1 3/2015 Wang
2015/0088522 A1 3/2015 Hendrickson et al.
2015/0092202 A1* 4/2015 Kawai ..... G06K 15/1868 358/1.2
2015/0096872 A1 4/2015 Woodburn
2015/0100196 A1 4/2015 Hollitield
2015/0115035 A1 4/2015 Meier et al.
2015/0127791 A1 5/2015 Kosecki et al.
2015/0128116 A1 5/2015 Chen et al.
2015/0133047 A1 5/2015 Smith et al.
2015/0134470 A1 5/2015 Hejl et al.
2015/0136851 A1 5/2015 Harding et al.
2015/0142492 A1 5/2015 Kumar
2015/0144692 A1 5/2015 Hejl

(56) References Cited

U.S. PATENT DOCUMENTS

| | | | |
|---|---|---|---|
| 2015/0144698 | A1 | 5/2015 | Teng et al. |
| 2015/0149946 | A1 | 5/2015 | Benos et al. |
| 2015/0161429 | A1 | 6/2015 | Xian |
| 2015/0186703 | A1 | 7/2015 | Chen et al. |
| 2015/0199957 | A1 | 7/2015 | Funyak et al. |
| 2015/0210199 | A1 | 7/2015 | Payne |
| 2015/0220753 | A1 | 8/2015 | Zhu et al. |
| 2015/0254485 | A1 | 9/2015 | Feng et al. |
| 2015/0286447 | A1 | 10/2015 | Thijssen et al. |
| 2015/0310243 | A1 | 10/2015 | Ackley |
| 2015/0310389 | A1 | 10/2015 | Crimm et al. |
| 2015/0327012 | A1 | 11/2015 | Bian et al. |
| 2016/0014251 | A1 | 1/2016 | Hejl |
| 2016/0040982 | A1 | 2/2016 | Li et al. |
| 2016/0042241 | A1 | 2/2016 | Todeschini |
| 2016/0057230 | A1 | 2/2016 | Todeschini et al. |
| 2016/0062473 | A1 | 3/2016 | Bouchat et al. |
| 2016/0092805 | A1 | 3/2016 | Geisler et al. |
| 2016/0101936 | A1 | 4/2016 | Chamberlin |
| 2016/0102975 | A1 | 4/2016 | McCloskey et al. |
| 2016/0104019 | A1 | 4/2016 | Todeschini et al. |
| 2016/0104274 | A1 | 4/2016 | Jovanovski et al. |
| 2016/0109219 | A1 | 4/2016 | Ackley et al. |
| 2016/0109220 | A1 | 4/2016 | Laffargue |
| 2016/0109224 | A1 | 4/2016 | Thuries et al. |
| 2016/0112631 | A1 | 4/2016 | Ackley et al. |
| 2016/0112643 | A1 | 4/2016 | Laffargue et al. |
| 2016/0117627 | A1 | 4/2016 | Raj et al. |
| 2016/0124516 | A1 | 5/2016 | Schoon et al. |
| 2016/0125217 | A1 | 5/2016 | Todeschini |
| 2016/0125342 | A1 | 5/2016 | Miller et al. |
| 2016/0133253 | A1 | 5/2016 | Braho et al. |
| 2016/0171597 | A1 | 6/2016 | Todeschini |
| 2016/0171666 | A1 | 6/2016 | McCloskey |
| 2016/0171720 | A1 | 6/2016 | Todeschini |
| 2016/0171775 | A1 | 6/2016 | Todeschini et al. |
| 2016/0171777 | A1 | 6/2016 | Todeschini et al. |
| 2016/0174674 | A1 | 6/2016 | Oberpriller et al. |
| 2016/0178479 | A1 | 6/2016 | Goldsmith |
| 2016/0178685 | A1 | 6/2016 | Young et al. |
| 2016/0178707 | A1 | 6/2016 | Young et al. |
| 2016/0179132 | A1 | 6/2016 | Harr et al. |
| 2016/0179143 | A1 | 6/2016 | Bidwell et al. |
| 2016/0179368 | A1 | 6/2016 | Roeder |
| 2016/0179378 | A1 | 6/2016 | Kent et al. |
| 2016/0180130 | A1 | 6/2016 | Bremer |
| 2016/0180133 | A1 | 6/2016 | Oberpriller et al. |
| 2016/0180136 | A1 | 6/2016 | Meier et al. |
| 2016/0180594 | A1 | 6/2016 | Todeschini |
| 2016/0180663 | A1 | 6/2016 | McMahan et al. |
| 2016/0180678 | A1 | 6/2016 | Ackley et al. |
| 2016/0180713 | A1 | 6/2016 | Bernhardt et al. |
| 2016/0185136 | A1 | 6/2016 | Ng et al. |
| 2016/0185291 | A1 | 6/2016 | Chamberlin |
| 2016/0186926 | A1 | 6/2016 | Oberpriller et al. |
| 2016/0188861 | A1 | 6/2016 | Todeschini |
| 2016/0188939 | A1 | 6/2016 | Sailors et al. |
| 2016/0188940 | A1 | 6/2016 | Lu et al. |
| 2016/0188941 | A1 | 6/2016 | Todeschini et al. |
| 2016/0188942 | A1 | 6/2016 | Good et al. |
| 2016/0188943 | A1 | 6/2016 | Linwood |
| 2016/0188944 | A1 | 6/2016 | Wilz et al. |
| 2016/0189076 | A1 | 6/2016 | Mellott et al. |
| 2016/0189087 | A1 | 6/2016 | Morton et al. |
| 2016/0189088 | A1 | 6/2016 | Pecorari et al. |
| 2016/0189092 | A1 | 6/2016 | George et al. |
| 2016/0189284 | A1 | 6/2016 | Mellott et al. |
| 2016/0189288 | A1 | 6/2016 | Todeschini |
| 2016/0189366 | A1 | 6/2016 | Chamberlin et al. |
| 2016/0189443 | A1 | 6/2016 | Smith |
| 2016/0189447 | A1 | 6/2016 | Valenzuela |
| 2016/0189489 | A1 | 6/2016 | Au et al. |
| 2016/0191684 | A1 | 6/2016 | DiPiazza et al. |
| 2016/0192051 | A1 | 6/2016 | DiPiazza et al. |
| 2016/0125873 | A1 | 7/2016 | Braho et al. |
| 2016/0202951 | A1 | 7/2016 | Pike et al. |
| 2016/0202958 | A1 | 7/2016 | Zabel et al. |
| 2016/0202959 | A1 | 7/2016 | Doubleday et al. |
| 2016/0203021 | A1 | 7/2016 | Pike et al. |
| 2016/0203429 | A1 | 7/2016 | Mellott et al. |
| 2016/0203797 | A1 | 7/2016 | Pike et al. |
| 2016/0203820 | A1 | 7/2016 | Zabel et al. |
| 2016/0204623 | A1 | 7/2016 | Haggert et al. |
| 2016/0204636 | A1 | 7/2016 | Allen et al. |
| 2016/0204638 | A1 | 7/2016 | Miraglia et al. |
| 2016/0316190 | A1 | 7/2016 | McCloskey et al. |
| 2016/0227912 | A1 | 8/2016 | Oberpriller et al. |
| 2016/0232891 | A1 | 8/2016 | Pecorari |
| 2016/0292477 | A1 | 10/2016 | Bidwell |
| 2016/0294779 | A1 | 10/2016 | Yeakley et al. |
| 2016/0306769 | A1 | 10/2016 | Kohtz et al. |
| 2016/0314276 | A1 | 10/2016 | Sewell et al. |
| 2016/0314294 | A1 | 10/2016 | Kubler et al. |
| 2016/0323310 | A1 | 11/2016 | Todeschini et al. |
| 2016/0325677 | A1 | 11/2016 | Fitch et al. |
| 2016/0327614 | A1 | 11/2016 | Young et al. |
| 2016/0327930 | A1 | 11/2016 | Charpentier et al. |
| 2016/0328762 | A1 | 11/2016 | Pape |
| 2016/0330218 | A1 | 11/2016 | Hussey et al. |
| 2016/0343163 | A1 | 11/2016 | Venkatesha et al. |
| 2016/0343176 | A1 | 11/2016 | Ackley |
| 2016/0364914 | A1 | 12/2016 | Todeschini |
| 2016/0370220 | A1 | 12/2016 | Ackley et al. |
| 2016/0372282 | A1 | 12/2016 | Bandringa |
| 2016/0373847 | A1 | 12/2016 | Vargo et al. |
| 2016/0377414 | A1 | 12/2016 | Thuries et al. |
| 2016/0377417 | A1 | 12/2016 | Jovanovski et al. |
| 2017/0010141 | A1 | 1/2017 | Ackley |
| 2017/0010328 | A1 | 1/2017 | Mullen et al. |
| 2017/0010780 | A1 | 1/2017 | Waldron et al. |
| 2017/0016714 | A1 | 1/2017 | Laffargue et al. |
| 2017/0018094 | A1 | 1/2017 | Todeschini |
| 2017/0046603 | A1 | 2/2017 | Lee et al. |
| 2017/0047864 | A1 | 2/2017 | Stang et al. |
| 2017/0053146 | A1 | 2/2017 | Liu et al. |
| 2017/0053147 | A1 | 2/2017 | Geramine et al. |
| 2017/0053647 | A1 | 2/2017 | Nichols et al. |
| 2017/0055606 | A1 | 3/2017 | Xu et al. |
| 2017/0060316 | A1 | 3/2017 | Larson |
| 2017/0061961 | A1 | 3/2017 | Nichols et al. |
| 2017/0064634 | A1 | 3/2017 | Van Horn et al. |
| 2017/0083730 | A1 | 3/2017 | Feng et al. |
| 2017/0091502 | A1 | 3/2017 | Furlong et al. |
| 2017/0091706 | A1 | 3/2017 | Lloyd et al. |
| 2017/0091741 | A1 | 3/2017 | Todeschini |
| 2017/0091904 | A1 | 3/2017 | Ventress |
| 2017/0092908 | A1 | 3/2017 | Chaney |
| 2017/0094238 | A1 | 3/2017 | Germaine et al. |
| 2017/0098947 | A1 | 4/2017 | Wolski |
| 2017/0100949 | A1 | 4/2017 | Celinder et al. |
| 2017/0108838 | A1 | 4/2017 | Todeschini et al. |
| 2017/0108895 | A1 | 4/2017 | Chamberlin et al. |
| 2017/0118355 | A1 | 4/2017 | Wong et al. |
| 2017/0123598 | A1 | 5/2017 | Phan et al. |
| 2017/0124369 | A1 | 5/2017 | Rueblinger et al. |
| 2017/0124396 | A1 | 5/2017 | Todeschini et al. |
| 2017/0124687 | A1 | 5/2017 | McCloskey et al. |
| 2017/0126873 | A1 | 5/2017 | McGary et al. |
| 2017/0126904 | A1 | 5/2017 | d'Armancourt et al. |
| 2017/0139012 | A1 | 5/2017 | Smith |
| 2017/0140329 | A1 | 5/2017 | Bernhardt et al. |
| 2017/0140731 | A1 | 5/2017 | Smith |
| 2017/0147847 | A1 | 5/2017 | Berggren et al. |
| 2017/0150124 | A1 | 5/2017 | Thuries |
| 2017/0169198 | A1 | 6/2017 | Nichols |
| 2017/0171035 | A1 | 6/2017 | Lu et al. |
| 2017/0171703 | A1 | 6/2017 | Maheswaranathan |
| 2017/0171803 | A1 | 6/2017 | Maheswaranathan |
| 2017/0180359 | A1 | 6/2017 | Wolski et al. |
| 2017/0180577 | A1 | 6/2017 | Nguon et al. |
| 2017/0181299 | A1 | 6/2017 | Shi et al. |
| 2017/0190192 | A1 | 7/2017 | Delario et al. |
| 2017/0193432 | A1 | 7/2017 | Bernhardt |
| 2017/0193461 | A1 | 7/2017 | Jonas et al. |

(56) References Cited

U.S. PATENT DOCUMENTS

| | | | |
|---|---|---|---|
| 2017/0193727 | A1 | 7/2017 | Van Horn et al. |
| 2017/0200108 | A1 | 7/2017 | Au et al. |
| 2017/0200275 | A1 | 7/2017 | McCloskey et al. |

* cited by examiner

SMART MEDIA HANGER WITH MEDIA WIDTH DETECTION

FIELD OF THE INVENTION

The present invention relates to apparatuses and methods to improve efficiency for printers, and in particular provide feedback to a user on the status of the media/ribbon in a printer.

BACKGROUND

Generally speaking a media/ribbon hanger or a "hanger" for media or ribbon of a printer is a mechanical hanger that holds media/ribbon in place, but does not comprise any feedback capability. A user may be required to manually view the printer in order to determine the status of media/ribbon in the printer.

Therefore, a need exists for a printer to provide a feedback mechanism to a user on to the status of the media/ribbon in the printer.

SUMMARY

Accordingly, in one aspect, the present invention embraces a method and apparatus for providing feedback to a user on the status of media/ribbon of a printer. The feedback may be provided by incorporating a feedback mechanism in a media/ribbon hanger or "hanger" of a printer. The feedback mechanism of the printer may be designed to work with one or more sensors to provide a feedback loop so that without an input from a user, the printer is able to detect the presence/absence of media/ribbon, as well as determine the width of the loaded media/ribbon. In another embodiment, the feedback mechanism is able to determine the weight of the roll of media/ribbon and hence determine the quantity of media/ribbon available on the media/ribbon hanger.

In an exemplary embodiment, a media/ribbon hanger of a printer provides feedback on a status of a roll of media/ribbon loaded in the media/ribbon hanger. The media/ribbon hanger comprises a plurality of moveable buttons located on a top layer of the media/ribbon hanger; a plurality of flaps located in a middle interior of the media/ribbon hanger, where each of the plurality of flaps is in an open state or a closed state based on the status of the roll of media/ribbon loaded in the media/ribbon hanger; and one or more sensors that determine a presence or an absence of the roll of media/ribbon on the media/ribbon hanger. If the one or more sensors determine the presence of the roll of media/ribbon loaded in the media/ribbon hanger, the one or more sensors then can determine a width of the roll of media/ribbon loaded in the media/ribbon hanger. Based on the determinations of the one or more sensors, the printer receives the status of the roll of media/ribbon loaded in the media/ribbon hanger.

Each of the plurality of moveable buttons is associated with a corresponding one of the plurality of flaps. If the roll of media/ribbon is not loaded on the media/ribbon hanger, the plurality of moveable buttons does not press down on the plurality of flaps causing an open state for the plurality of flaps. If the roll of media/ribbon is loaded on the media/ribbon hanger, a portion of the plurality of moveable buttons underneath the media ribbon presses down the plurality of flaps causing a closed state for the plurality of flaps.

In another exemplary embodiment, the one or more sensors comprise a reflective sensor. The reflective sensor transmits a first light signal through the middle interior of the media/ribbon hanger, wherein, the first light signal reflects off a first flap in an open state causing a generation of a second light signal. The reflective sensor receives the second light signal with different light intensity depending on the location of the first flap allowing determination of the status of the roll of media/ribbon loaded on the media/ribbon hanger. The reflective sensor is located at one end of the media/ribbon hanger.

In yet another exemplary embodiment, the one or more sensors may comprise a plurality of transmissive sensors. Each transmissive sensor includes a light emitter and a light receiver. Each of the plurality of transmissive sensors transmit a light signal via the light emitter. If the light signal of each of the plurality of transmissive sensors is in proximity to one of the plurality of flaps in an open condition, then the each of the light receivers do not received the light signal from the light emitter and generate a low level signal. If the light signal of each of the plurality of transmissive sensors is in proximity of the one of the plurality of flaps in a closed condition, then the each of the plurality of light receiver receive the light signal from the light emitter and generate a high level signal. The number of high or low level signals received by the plurality of transmissive sensors determines the status of the roll of media/ribbon.

In another exemplary aspect, the present invention embraces a method comprising transmitting, by a sensor, a first light signal into a media/ribbon hanger of a printer; receiving, by the sensor, a second light signal generated from a reflection of the first light signal; and sending, by the sensor, a light intensity information of the second light signal to a system. The system determines a status of the roll of media/ribbon loaded on the media/ribbon hanger. The status of the roll of media/ribbon comprises a determination whether the media/ribbon hanger is empty. If the media/ribbon hanger is not empty, the system determines a width of the roll of media/ribbon. The light intensity information of the second light signal is based on whether the roll of media/ribbon presses down on one or more of a plurality of moveable buttons causing the second light signal to reflect off a specific one of a plurality of flaps. The plurality of moveable buttons is located on top of the media/ribbon hanger, and the plurality of flaps is located in a middle interior of the media/ribbon hanger and is each coupled to the plurality of moveable buttons. Each sensor comprises an emitter for transmitting and a receiver for receiving.

In yet another exemplary embodiment, a method may comprise transmitting, by each sensor of a plurality of sensors, a corresponding light signal into a media/ribbon hanger of a printer; receiving or not receiving, by each sensor of the plurality of sensors, the corresponding light signal based on a flap status of each of a plurality of corresponding flaps in the media/ribbon hanger generating, by each sensor of the plurality of sensors, either a high level signal or a low level signal based on a reception status of each corresponding receiver of the plurality of sensors; and sending, by each sensor of the plurality of sensors, their respective signal level to a system. The system counts a number of high level signals or low level signals to determine a status of a roll of media/ribbon loaded on the media/ribbon hanger Each sensor of the plurality of sensors comprise a corresponding emitter for transmitting and a corresponding receiver for receiving.

The status of the roll of media/ribbon comprises a determination whether the media/ribbon hanger is empty, and if the media/ribbon hanger is not empty, the system determines a width of the roll of media/ribbon. The flap status of each of the plurality of corresponding flaps in the media/ribbon hanger is determined based on whether the roll of media/ribbon presses down on one or more of a plurality of moveable buttons causing the corresponding flap to obstruct the light signal transmission from the emitter to the receiver of each of the plurality of sensors. The one or more of the plurality of moveable buttons are located on top of the media/ribbon hanger, and the plurality of corresponding flaps are located in a middle interior of the media/ribbon hanger and are correspondingly coupled to the plurality of moveable buttons.

In an exemplary embodiment, a media/ribbon hanger of a printer for providing feedback on a status of a roll of media/ribbon loaded on the media/ribbon hanger may comprise: 1) a plurality of moveable buttons located on a top layer of the media/ribbon hanger. The roll of media/ribbon loaded on the media/ribbon hanger applies pressure on the plurality of moveable buttons; 2) a plurality of pressure sensors, located underneath the plurality of moveable buttons. Each of the plurality of pressure sensors is paired with a corresponding one of the plurality of moveable buttons; 3) a pivot bar located on a bottom of the media/ribbon hanger; and 4) a load force sensor located at one end of the media/ribbon hanger and positioned on an edge of the pivot bar. The plurality of pressure sensors and the load force sensor provide feedback to a processor of the printer to determine the status of the roll of media/ribbon including a presence of the roll of media/ribbon, a width of the roll of the media/ribbon, and a quantity of media/ribbon available in the roll of media/ribbon.

The plurality of pressure sensors determines the presence of the roll of media/ribbon. The plurality of pressure sensors determines the width of the roll of media/ribbon and the quantity of media/ribbon available in the roll of media/ribbon. A number of pressure sensors located on the media/ribbon hanger determines an accuracy of the width determination. If the roll of media/ribbon is not loaded on the media/ribbon hanger, the plurality of moveable buttons does not press down the plurality of pressure sensors and activate the plurality of pressure sensors. If the roll of media/ribbon is loaded on the media/ribbon hanger, a portion of the plurality of moveable buttons underneath the media/ribbon presses down the plurality of pressure sensors, causing a force to be applied to the pivot bar, which in turn is sensed by the load force sensor. An output of the load force sensor determines the quantity of media/ribbon available in the roll of media/ribbon. A diameter of the roll of media/ribbon is proportional to an amount of contract pressure applied to the load force sensor. When the roll of media/ribbon is a label, the printer monitors a pressure change over a period of time and determines a number of labels printed in the period of time. When the roll of media/ribbon is a ribbon, the printer monitors a pressure change over a period of time to determine an amount of distance of continuous ribbon remaining on the roll of media/ribbon.

In another exemplary embodiment, a method for providing feedback on a status of a roll of media/ribbon loaded on the media/ribbon hanger may comprise the steps of: 1) loading, at a media/ribbon hanger of a printer, a roll of media/ribbon on the media/ribbon hanger; 2) applying pressure, at the media/ribbon hanger, by the roll of media/ribbon on a number of a plurality of pressure sensors located underneath the roll of media/ribbon; and 3) sending, at the media/ribbon hanger, the number of the plurality of pressure sensors receiving pressure from the roll of media/ribbon to a processor of the printer. The processor of the printer determines a width of the roll of media/ribbon based on the number of the plurality of pressure sensors receiving pressure from the roll of media/ribbon, and determines a quantity of media/ribbon available in the roll of media/ribbon based on a determination of a weight of the roll of media/ribbon. If the number of the plurality of pressure sensors receiving pressure from the roll of media/ribbon is zero, the roll of media/ribbon is not present.

Located on a top layer of the media/ribbon hanger, above the plurality of pressure sensors, is a plurality of moveable buttons. Each of the plurality of moveable buttons is paired with a corresponding one of the plurality of pressure sensors. An accuracy for determining the width of the roll of media/ribbon is based on a quantity of pressure sensors located on the media/ribbon hanger.

In yet another exemplary embodiment, a method for providing feedback on a status of a roll of media/ribbon loaded on the media/ribbon hanger may comprise the steps of: 1) loading, at a media/ribbon hanger, a roll of media/ribbon on the media/ribbon hanger; 2) applying pressure, at the media/ribbon hanger, by the roll of media/ribbon on a pivot bar located on a bottom of the media/ribbon hanger; 3) pivoting, at the media/ribbon hanger, by the pivot bar, based on a force applied by the roll of media/ribbon, causing contact pressure to be applied to a load force sensor; and 4) sending, at the media/ribbon hanger, to a processor of a printer associated with the media/ribbon hanger, a signal representing the contact pressure of the load force sensor. The processor of the printer determines a presence of the roll of media/ribbon, and if present, the processor of the printer determines a diameter of the roll of media/ribbon.

The diameter of the roll of media/ribbon is proportional to an amount of contact pressure applied to the load force sensor.

When the roll of media/ribbon is a label, the printer monitors a pressure change over a period of time and determines a number of labels printed in the period of time.

When the roll of media/ribbon is a ribbon, the printer monitors a pressure change over a period of time to determine an amount of distance of continuous ribbon remaining on the roll of media/ribbon. When the contact pressure reached a predefined threshold, an alert is sent to the processor of the printer to indicate a status of the roll of media/ribbon.

In yet another exemplary embodiment, a printer may provide feedback on a status of a roll of media/ribbon loaded in the media/ribbon hanger. The printer comprises: (1) a housing; (2) a hanger having a top surface and open portion below the top surface; (3) a plurality of moveable buttons located on a top of the hanger; (4) a plurality of flaps located below the top surface of the hanger, wherein each of the plurality of flaps is associated with a corresponding one of the plurality of moveable buttons; (5) each of the plurality of flaps being in an open state or a closed state based on a position of a roll of media/ribbon loaded on the hanger; (6) one or more sensors that determine a state of at least one of the plurality of flaps and output at least one signal corresponding to the state; and (7) a processor for processing the at least one output signal to determine at least one of a presence of the roll of media/ribbon loaded on the hanger and a width of the roll of media/ribbon loaded on the hanger.

The one or more sensors comprise a reflective sensor. The reflective sensor transmits a first light signal through the open portion of the hanger, wherein, the first light signal reflects off a first flap in the open state causing a generation of a second light signal. The reflective sensor receives the second light signal with a different light intensity, depending on a location of the first flap, allowing a determination of a status of the roll of media/ribbon loaded on the hanger. the reflective sensor receives the second light signal, and based on a measured time of flight determines if the media/ribbon is loaded on the hanger and/or determines the width of the media/ribbon loaded on the hanger.

In yet another exemplary embodiment, a method may comprise: transmitting, by an emitter, a first light signal into a hanger of a printer; receiving, by the emitter, a second light signal generated from a reflection of the first light signal; and outputting, by the emitter, information corresponding to the second light signal to a processor. The processor determines a width of a roll of media/ribbon loaded on the hanger.

The emitter receives the second light signal, and based on a measured time of flight determines if the media/ribbon is loaded on the hanger and/or determines the width of the media/ribbon loaded on the hanger.

The second light signal is based on whether the roll of media/ribbon presses down on one or more of a plurality of moveable buttons causing a displacement of the one or more corresponding flaps, thereby causing the first light signal to reflect off a specific one of a plurality of flaps. The specific flap is the first flap in an open state.

In yet another exemplary embodiment, a printer comprising: (1) a housing; (2) a hanger having a top surface and an edge adjacent the housing; (3) a plurality of moveable buttons located on a top surface of the hanger; (4) a plurality of pressure sensors, located underneath the plurality of moveable buttons. Each of the plurality of pressure sensors is paired with a corresponding one of the plurality of moveable buttons, and the roll of media or ribbon loaded on the hanger applies pressure on at least one of the plurality of moveable buttons, thereby registering a pressure on the at least one corresponding pressure sensor. (5) A pivot bar located at one end of the hanger. And (6) a load force sensor supported by the housing and positioned adjacent to an edge of the hanger, wherein, when the media or ribbon is loaded onto the hanger the edge of the hanger presses against the load force sensor. The plurality of pressure sensors and the load force sensor provide feedback to a processor of the printer to determine the status of the roll of media or ribbon including at least one of a presence of the roll of media or ribbon, a width of the roll of the media or ribbon, and a quantity of media or ribbon available in the roll of media or ribbon.

The foregoing illustrative summary, as well as other exemplary objectives and/or advantages of the invention, and the manner in which the same are accomplished, are further explained within the following detailed description and its accompanying drawings.

DETAILED DESCRIPTION

Figure 1:
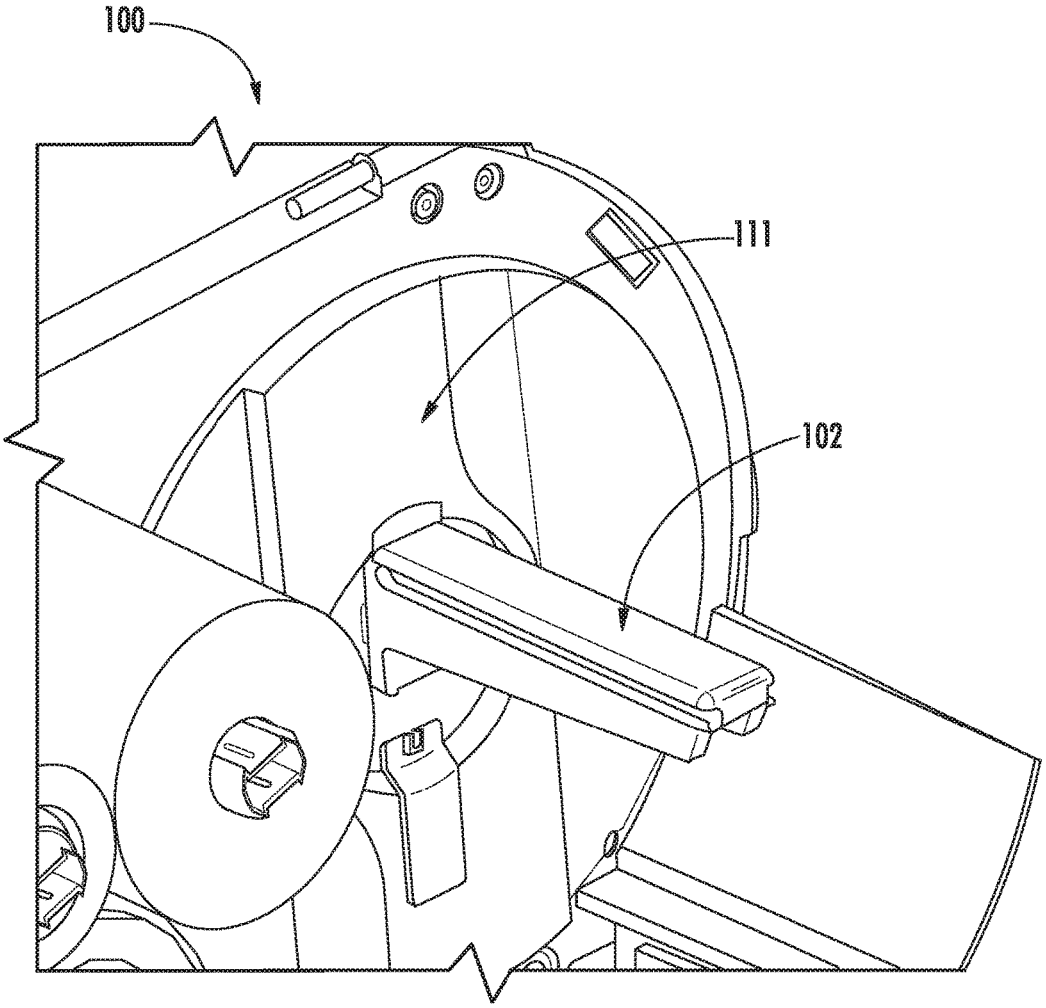
FIG. 1 illustrates an embodiment of a media/ribbon hanger without a feedback mechanism.

The present invention, as described herein, is based on applications supporting a variety of types of media. The media may include, but not limited to, ribbon, paper, labels and tickets. The term "media/ribbon", as used herein, refers to the variety of types of media. The term "media/ribbon" may also be referred to as a "roll of media/ribbon". Also "media/ribbon" is equivalent to "media or ribbon". A hanger of the printer supports the media or ribbon.

The present invention embraces a method and apparatus for providing feedback to a user on the status of media/ribbon of a printer. The feedback may be provided by incorporating a feedback mechanism in a media/ribbon hanger or "hanger" of a printer. The printer may be a thermal printer, but may be another type of printer. The feedback mechanism of the printer may be designed to work with one or more sensors to provide a feedback loop so that without an input from a user, the printer may detect the presence/absence of roll of media/ribbon, as well as determine the width of the loaded media/ribbon. In another embodiment, the feedback mechanism is able to determine the weight of the roll of media/ribbon and hence determine the quantity of media/ribbon available on the media/ribbon hanger.

In two exemplary embodiments, media/ribbon hanger with a feedback mechanism may comprise moveable buttons with moving flaps and one or more light sensors (or optical sensors). These two exemplary embodiments are referred to as a first solution (reflective sensor) and a second solution (transmissive sensor). Upon loading of a roll of media/ribbon, the moveable buttons may compress the flaps based on the weight of the roll of media/ribbon to allow the light sensors to determine the width of the roll of media/ribbon and provide a feedback message to the printer/user. The sensors may be a reflective sensor or a transmissive sensor. The moveable buttons may be another type of sensor that is mounted on the top of the hanger.

In another exemplary embodiment, the feedback mechanism may comprise a plurality of pressure sensors and a load force sensor. This exemplary embodiment may be referred to as a third solution.

In one aspect of the third solution, when a roll of media/ribbon is loaded into the media/ribbon hanger, the weight of the roll of media/ribbon applies pressure on the pressure sensors underneath the roll of media/ribbon. The plurality pressure sensors may then detect information relative to 1) the presence of the roll of media/ribbon, 2) the weight of the roll of media, and subsequently the diameter/quantity available on the roll of media/ribbon, and 3) the width of the roll of media/ribbon. The sensors provide a feedback message to a processor of the printer that then generates a message or alert for a user.

In another aspect of the third solution, when a roll of media/ribbon is loaded into the media/ribbon hanger, the weight of the roll of media/ribbon applies pressure on a pivot bar, which subsequently applies pressure on the load force sensor. Based on the pressure applied to the load force sensor, the load force sensor may then detect information relative to 1) the presence of the roll of media/ribbon, 2) and if present, detects the weight of the roll of media, and subsequently the diameter/quantity available on the roll of media/ribbon. The sensors provide a feedback message to a processor of the printer that then generates a message or alert for a user.

Based on the feedback messages from the plurality of pressure sensors and the load force sensor, the printer may monitor the change in pressure over time. The printer may determine the status of the media or ribbon and if the media or ribbon is depleted. The printer may provide a low media alert message to a user.

FIG. 1 illustrates exemplary embodiment 100 of a printer comprising a media/ribbon hanger 102. A face 111 of the printer is indicated in FIG. 1. Media/ribbon hanger 102 does not have a feedback mechanism.

Figure 2:
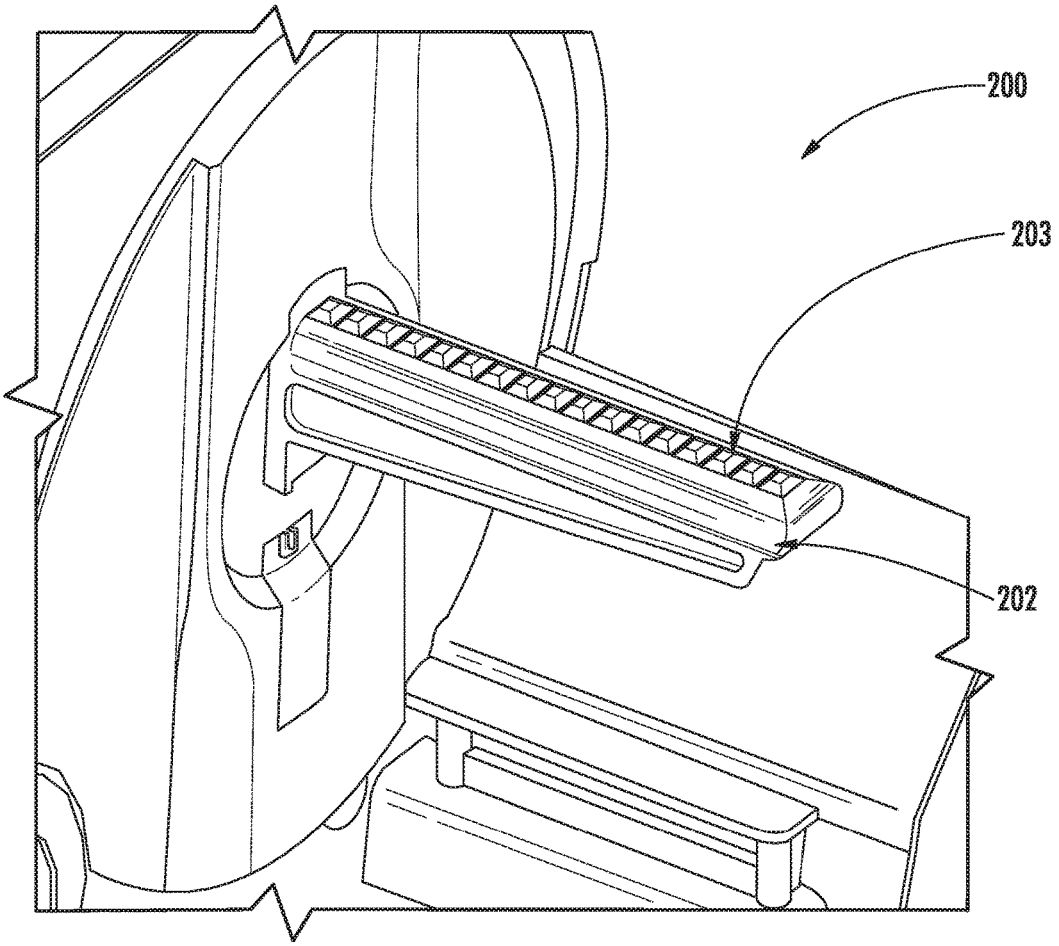
FIG. 2 illustrates exemplary embodiment of a media/ribbon hanger with a feedback mechanism.
Figure 3:
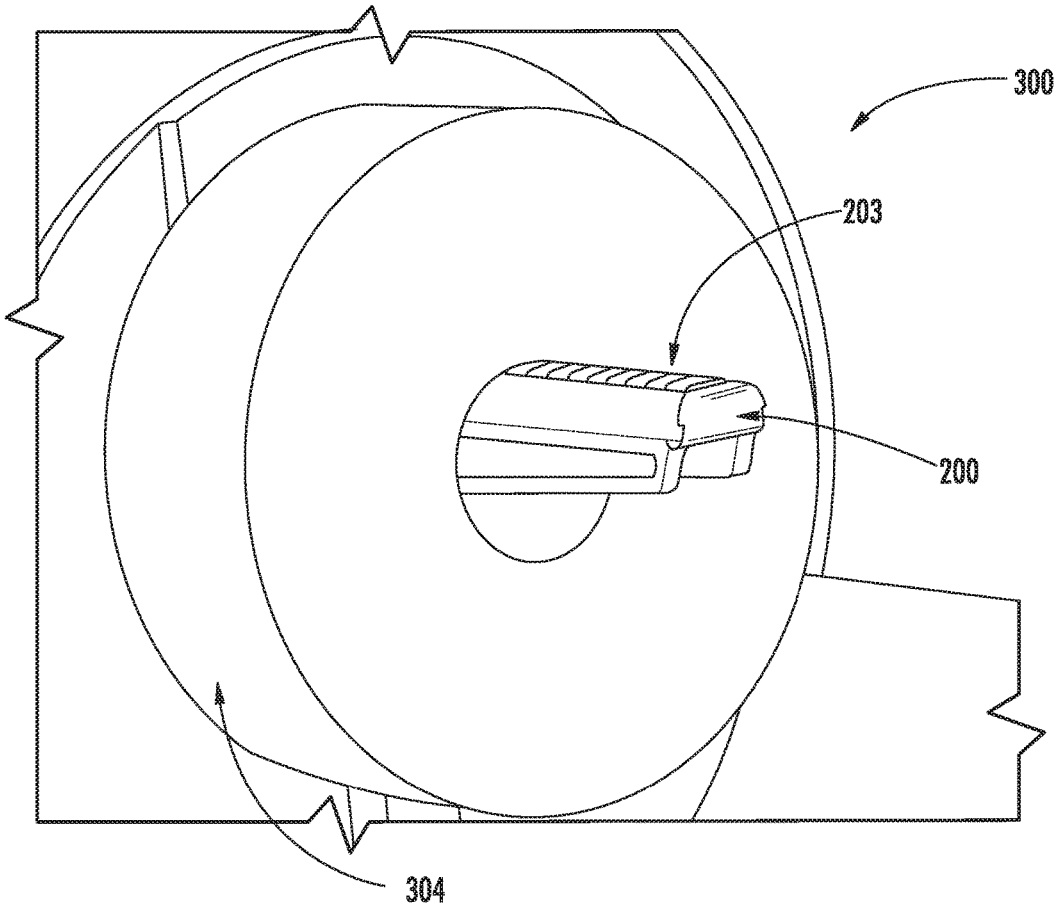
FIG. 3 illustrates the exemplary embodiment of a media/ribbon hanger, as shown in FIG. 2, loaded with a roll of media/ribbon.

FIG. 2 illustrates an exemplary embodiment 200 of a printer comprising media/ribbon hanger 202 that incorporates a feedback mechanism comprising a plurality of buttons 203 located on the top of the media/ribbon hanger 202. FIG. 3 illustrates an exemplary embodiment 300 of a printer comprising media/ribbon hanger 202 that incorporates a feedback mechanism comprising a plurality of buttons 203 located on the top of the media/ribbon hanger 202. Exemplary embodiment 300 is shown with media/ribbon 304 installed on the media/ribbon hanger 202. Each button in the plurality of buttons 203 may be independently moveable based on a weight applied to the top of each button. Media/ribbon 304 includes a media/ribbon spool (not shown in FIG. 3) that is positioned between the media/ribbon 304 and media/ribbon hanger 202. For example, FIG. 5B shows media/ribbon spool 533 and FIG. 6B shows media/ribbon spool 633. Media/ribbon hanger 202 supports a feedback mechanism for the first solution and the second solution.

The feedback mechanism may detect the presence/absence and width of media/ribbon 304. Knowledge of the width may provide assistance to a user for print registration.

The feedback mechanism has two states: and open state and a closed state. In the open state, media or ribbon are not installed on the media/ribbon hanger 202. The media/ribbon hanger 202 is empty or depleted as illustrated in FIG. 2. In this situation, there is no or very little weight pressing down on the plurality of buttons 203.

Figure 4:
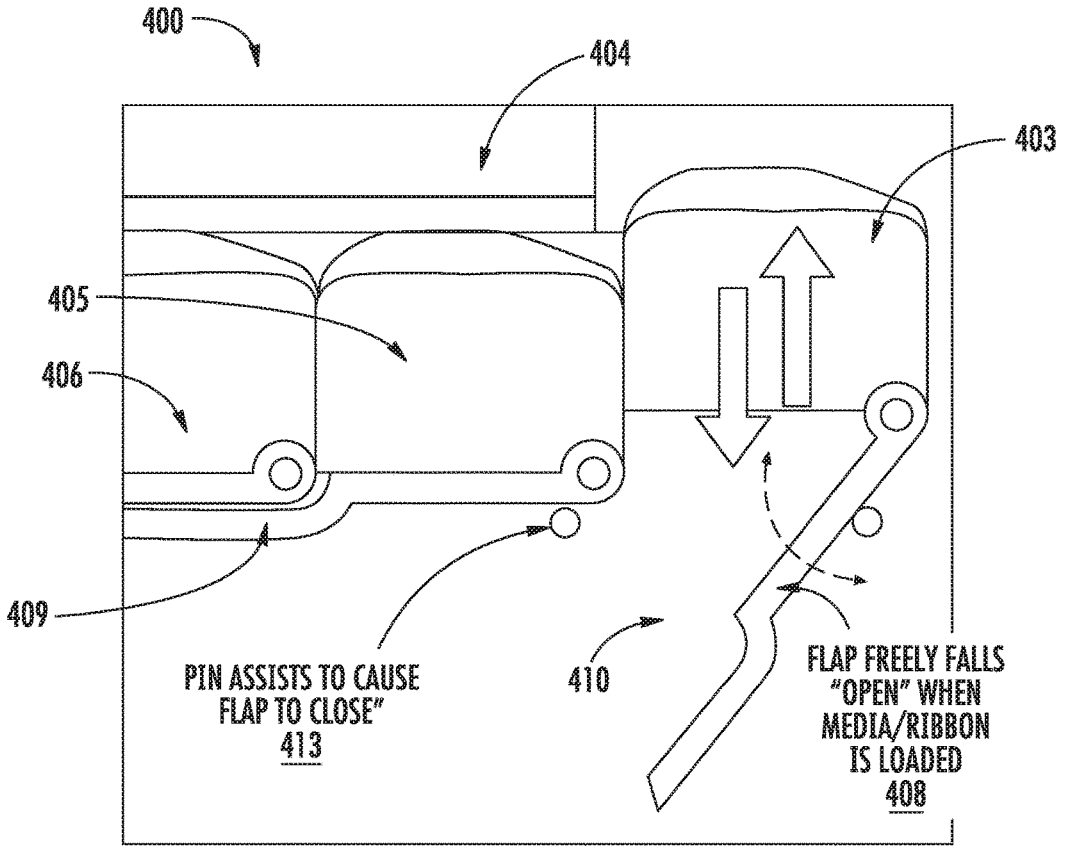
FIG. 4 illustrates an exemplary embodiment of a feedback mechanism, used in a first and a second solution based on moveable buttons and flaps incorporated in a media/ribbon hanger.

FIG. 4 illustrates an exemplary embodiment 400 of a portion of a feedback mechanism for media/ribbon hanger 202. FIG. 4 is also included in FIG. 5B. The portion includes moveable button 403, moveable button 405, flap 408, flap 409, reflective flap surface 410 of flap 408, pin 413, and media/ribbon 404. As illustrated, there is little or no weight applied to the top of moveable button 403. Therefore, moveable button 403 is not pushed down and is in an open state. Flap 408, which is pivotally attached to moveable button 403, freely falls "open" from a substantially horizontal position to a largely vertical position relative to media/ribbon hanger 202. The condition of little or no weight applied to moveable button 403 may occur when media or ribbon is not loaded in media/ribbon hanger 202 or the roll of media or ribbon is depleted. The reflective flap surface 410 of flap 408 may be able to reflect a light signal.

FIG. 4 also illustrates media/ribbon 404 positioned on top of moveable button 405. Effectively, this means that media/ribbon 404 is loaded on media/ribbon hanger 202 to cause a closed status (see media/ribbon hanger 522 of FIG. 5B). Moveable button 405 is push downward causing flap 409 to pivot upward and be positioned next to moveable button 405 and an adjacent button 406, as illustrate in FIG. 4. Pin 413 assists to cause flap 409 to "close". In this closed state, flap 409 may be in a substantially horizontal position relative to media/ribbon hanger 202. Note that there may be a corresponding relationship between each button and each flap, e.g., moveable button 403 and flap 408, and moveable button 405 and flap 409.

Figure 5A:
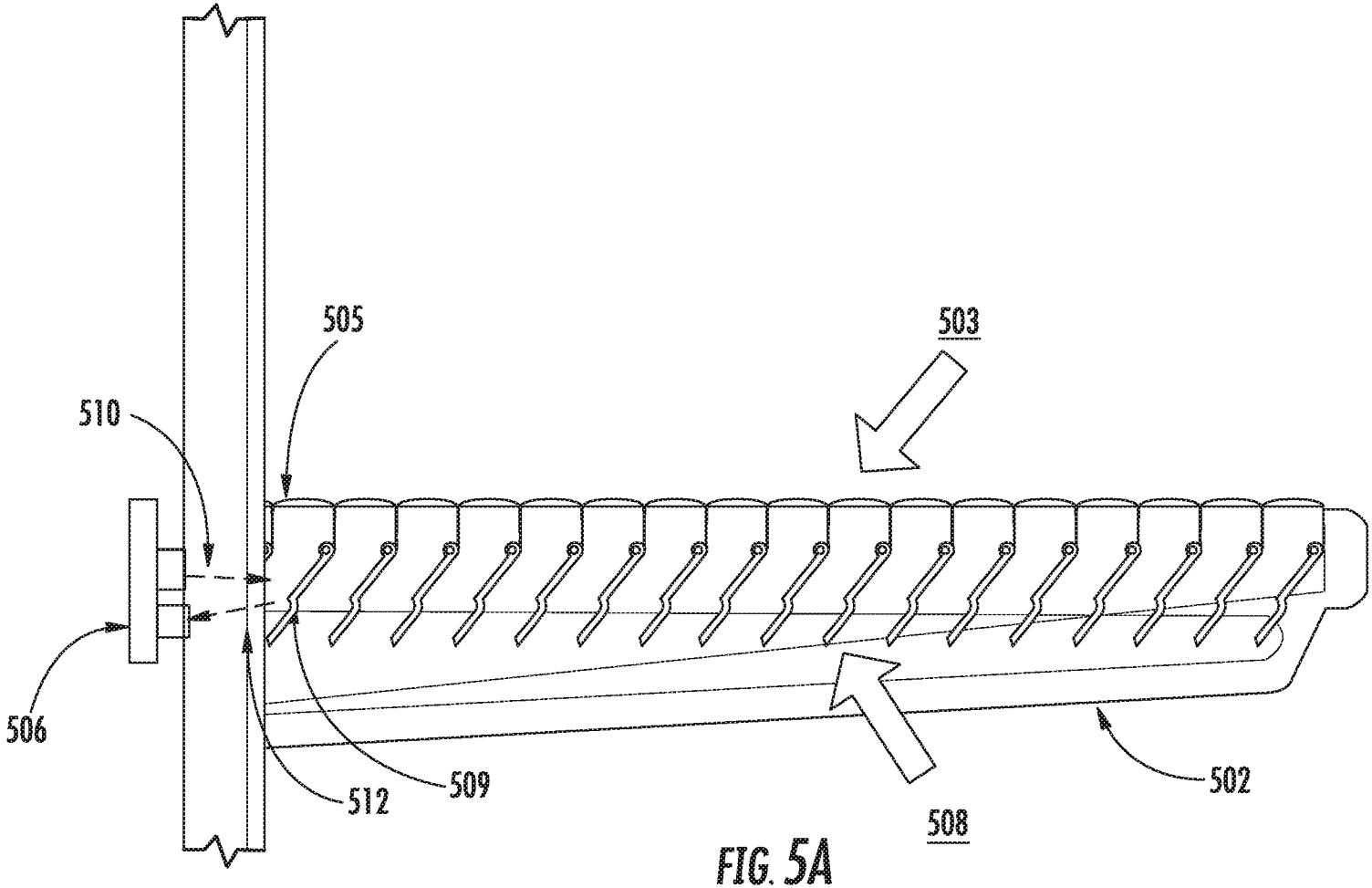
FIG. 5A illustrates an exemplary embodiment of a first solution for a media/ribbon hanger shown in an open state without media/ribbon loaded in the media/ribbon hanger.
Figure 5B:
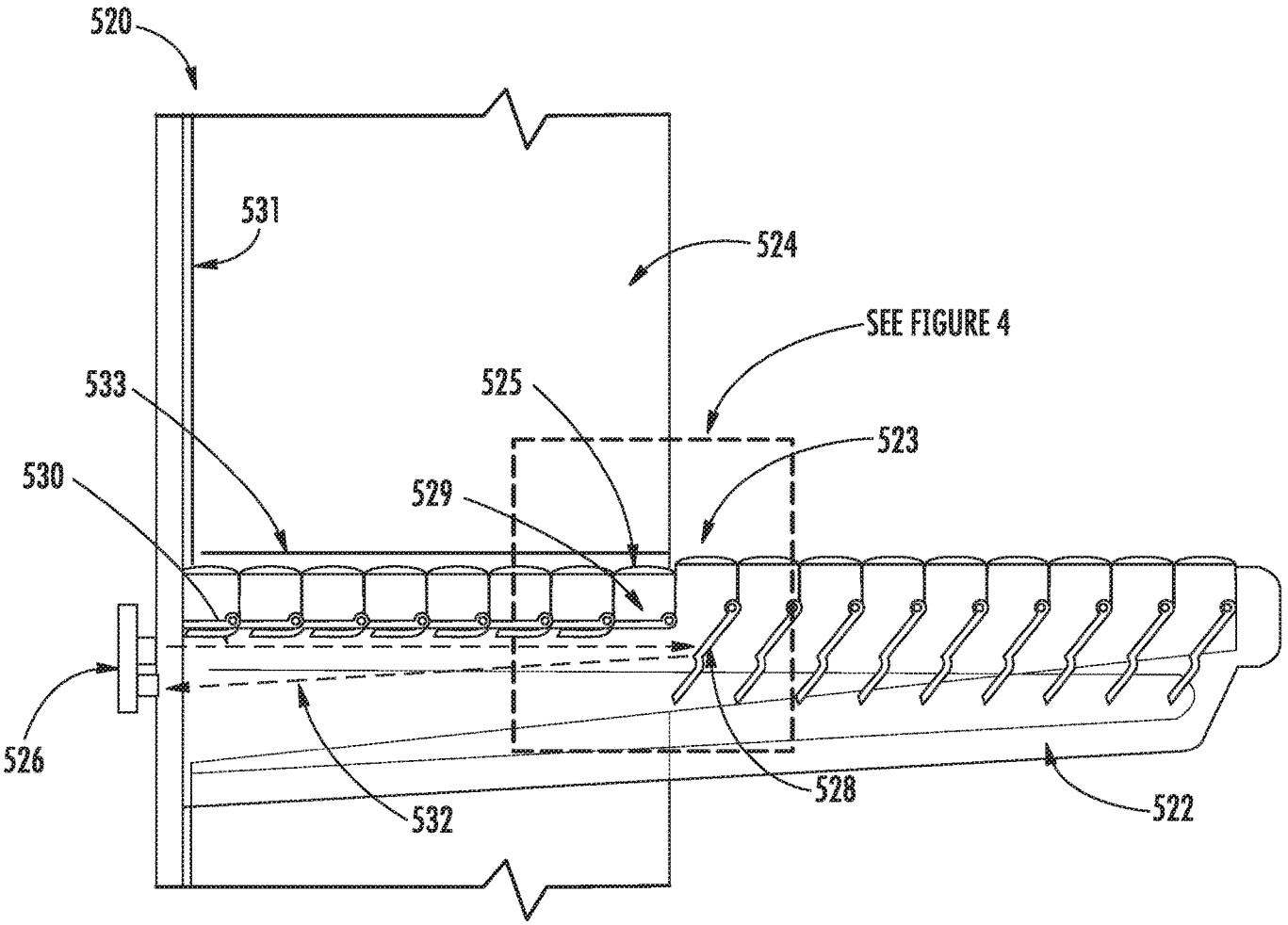
FIG. 5B illustrates an exemplary embodiment of the first solution of a media/ribbon hanger shown in a closed state with media/ribbon loaded in the media/ribbon hanger.

FIG. 5A illustrates an exemplary embodiment 500 of a first solution for a media/ribbon hanger 502 shown in an open state without media or ribbon loaded in the media/ribbon hanger 502. Media/ribbon hanger 502 may incorporate a feedback mechanism including the components described in FIG. 4. Media/ribbon hanger 502 comprises a plurality of buttons 503, located on the top layer of the media/ribbon hanger 502, a reflective sensor 506, located at one end of the media/ribbon hanger 502, and a plurality of flaps 508, located in the middle interior of the media/ribbon hanger 502. As previously noted, media/ribbon hanger 502 is not loaded with media or ribbon. Generally, with no media or ribbon loaded in the media/ribbon hanger 502, there is essentially no weight to apply pressure on the plurality of buttons 503.

Accordingly, media/ribbon hanger 502 is configured in an open state. In the absence of media or ribbon, the plurality of buttons 503 are not pressed down. Correspondingly, the plurality of flaps 508, which are located underneath the plurality of buttons 503, freely fall from an approximate horizontal position to a position that is largely vertical, as illustrated by the plurality of flaps 508. Also, as illustrated, there is a 1:1 association between one of the plurality of buttons 503 and a corresponding one of the plurality of flaps 508. For example, moveable button 505 corresponds with flap 509. As illustrated in FIG. 5A, since media or ribbon are not loaded in media/ribbon hanger 502, moveable button 505 is not pressed down. Therefore, flap 509 is in an open state and is able to reflect a light signal.

Reflective sensor 506 comprises a transmitter/receiver that may be used to transmit and receive signal of light in the middle interior portion of the media/ribbon hanger 502. Transmitted light may be reflected off flap 509, since it has an open state, and be received by the reflective sensor 506. Since the signal of light reflects of the flop closest to the reflective sensor 506, the amount of light received is higher than if the light signal reflected on one of the other flaps. This information is sent to a system in the printer that determines a roll of media or ribbon is not present on media/ribbon hanger 502.

More specifically, the reflective sensor 506 transmits a first light signal 510 through the middle interior portion of the media/ribbon hanger 502. Per FIG. 7A, the first light signal 510 is generated by Led 702. The first light signal 510 is reflected by the surface of flap 509. Flap 509 is the first one of the plurality of flaps 508, located proximate to or next to reflective sensor 506. The second light signal 512 is received by a phototransistor 704 (see FIG. 7A) of the reflective sensor 506. The reflective sensor 506 then determines the light intensity of the second light signal 512 received by the phototransistor 704. Since the first light signal 510 was reflected by flap 509, the first one of the plurality of flaps 508 proximate to or next to reflective sensor 506, the light intensity of the second light signal 512 received by the reflective sensor 506 may be measured as a high level light intensity. A determination may be made that media/ribbon hanger 502 is not loaded with media or ribbon based on the high level light intensity received by reflective sensor 506. In other words, depending on the amount of light received by reflective sensor 506 (i.e., signal strength or light intensity of the light), the printer may detect the number of closed state flaps and determine the media width of the media or ribbon. The light intensity may decrease as the media or ribbon width increases.

FIG. 5B illustrates an exemplary embodiment 520 for the first solution of a feedback mechanism for media/ribbon hanger 522. Shown with a first selection of one or more buttons in a closed state and a second selection of the one or more buttons in an open state. The closed state flaps are on the left side of media/ribbon hanger 522 and the open states are on the right side of media/ribbon hanger 522. FIG. 5B shows media/ribbon 524 loaded on media/ribbon hanger 522 causing the first selection of buttons to be in a closed state. Specifically, moveable button 525 is pressed down causing corresponding flap 529 to be in a closed state. Correspondingly, moveable button 523 is not pressed down allowing flap 528 to freely fall into an open state. When media/ribbon 524 is loaded on media/ribbon hanger 522, one edge of the media/ribbon 524 is positioned next to face 531 of the printer such that the media/ribbon 524 is pressing against face 531.

Reflective sensor 526 transmits a third light signal 530 through the middle interior portion of the media/ribbon hanger 522. The third light signal 530 is reflected off the surface of flap 528, generating a fourth light signal 532 that is subsequently received by a phototransistor 704 (see FIG. 7A) of the reflective sensor 526. As compared with FIG. 5A, third light signal 530 travels a greater distance than first light signal 510. Accordingly, the received light intensity of fourth light signal 532 at reflective sensor 526 is lower than the received light intensity of second light signal 512 at reflective sensor 506. A determination may be made that media/ribbon hanger 522 has media or ribbon loaded based on the received light intensity of reflective sensor 526.

Figure 6A:
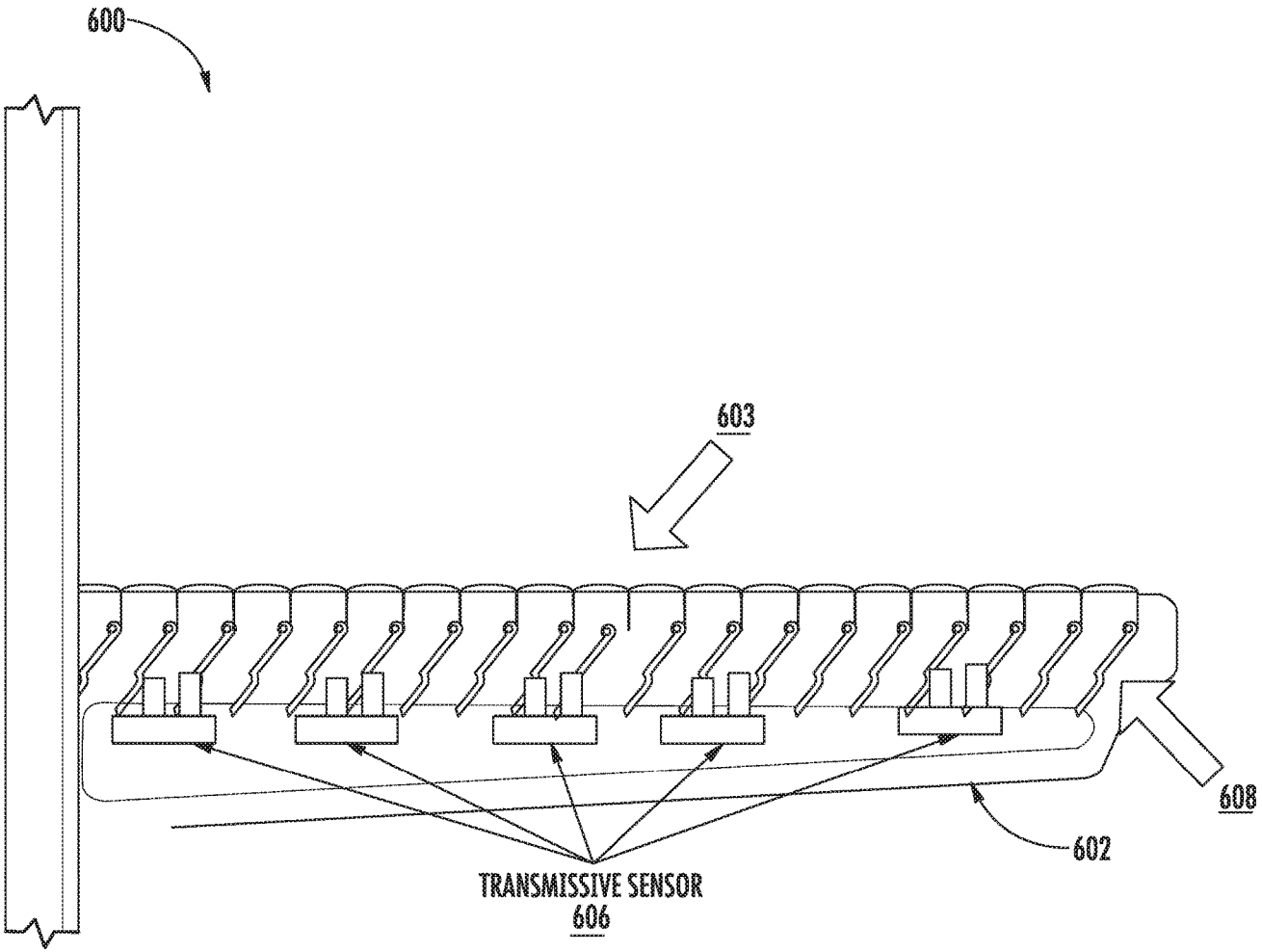
FIG. 6A illustrates an exemplary embodiment of a second solution for a media/ribbon hanger shown in an open state without media/ribbon loaded in the media/ribbon hanger.
Figure 6B:
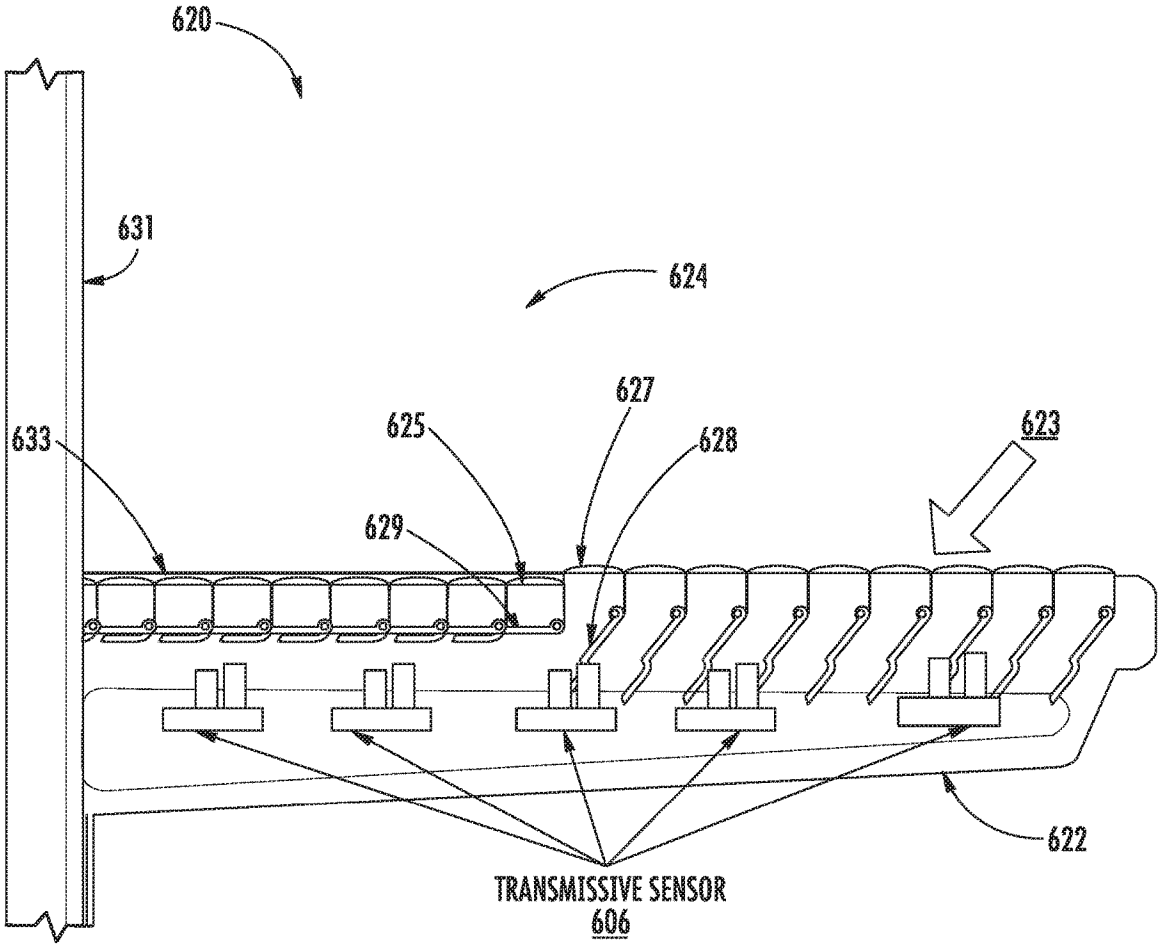
FIG. 6B illustrates an exemplary embodiment of the second solution of a media/ribbon hanger shown in a closed state with media/ribbon loaded in the media/ribbon hanger.

FIG. 6A illustrates an exemplary embodiment 600 of a second solution for a media/ribbon hanger 602 shown with all flaps in an open state without media or ribbon loaded in the media/ribbon hanger 602. Media/ribbon hanger 602 may incorporate a feedback mechanism including the components described in FIG. 4. Media/ribbon hanger 602 comprises a plurality of buttons 603, located on the top of the media/ribbon hanger 602, transmissive sensors 606, located horizontally in the middle interior of the media/ribbon hanger 602, and a plurality of flaps 608, located in the middle interior of the media/ribbon hanger 602, between the plurality of buttons 603 and the transmissive sensors 606. As illustrated, media/ribbon hanger 602 is not loaded with media or ribbon. Generally, with no media or ribbon loaded in the media/ribbon hanger 602, there is essentially no weight to apply pressure on the plurality of buttons 603.

In the second solution, transmissive sensors 606, are positioned below the plurality of flaps. The spacing between each sensor may be based on the desired resolution desired to determine the width of the roll of media or ribbon. A sample value for the resolution may be approximately 1 inch. Transmissive sensors 606 may detect the presence of one of a plurality of flaps 608 and based on this detection, transmissive sensors 606 may provide a high level signal or a low level signal. The width of media or ribbon may be estimated based on the detection of one of the plurality of flaps 608. In one embodiment, either a transmissive type of sensor or a reflective type of sensor may be used for second solution implementation. In another embodiment, a plurality of reflective filters may be used in the second solution.

Figure 7A:
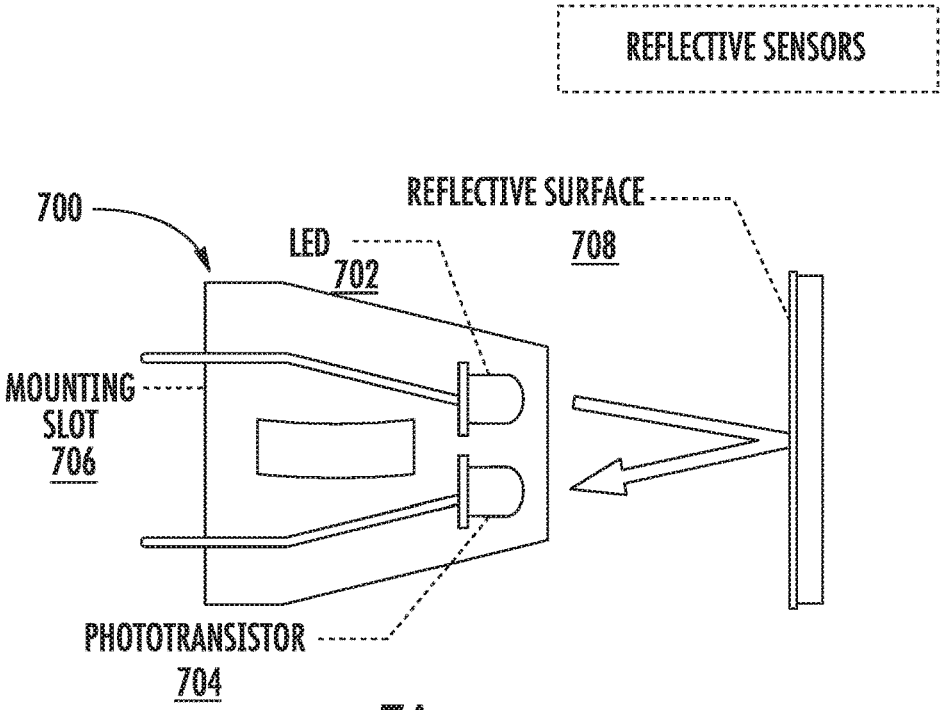
FIG. 7A illustrates an exemplary embodiment a reflective sensor.
Figure 7B:
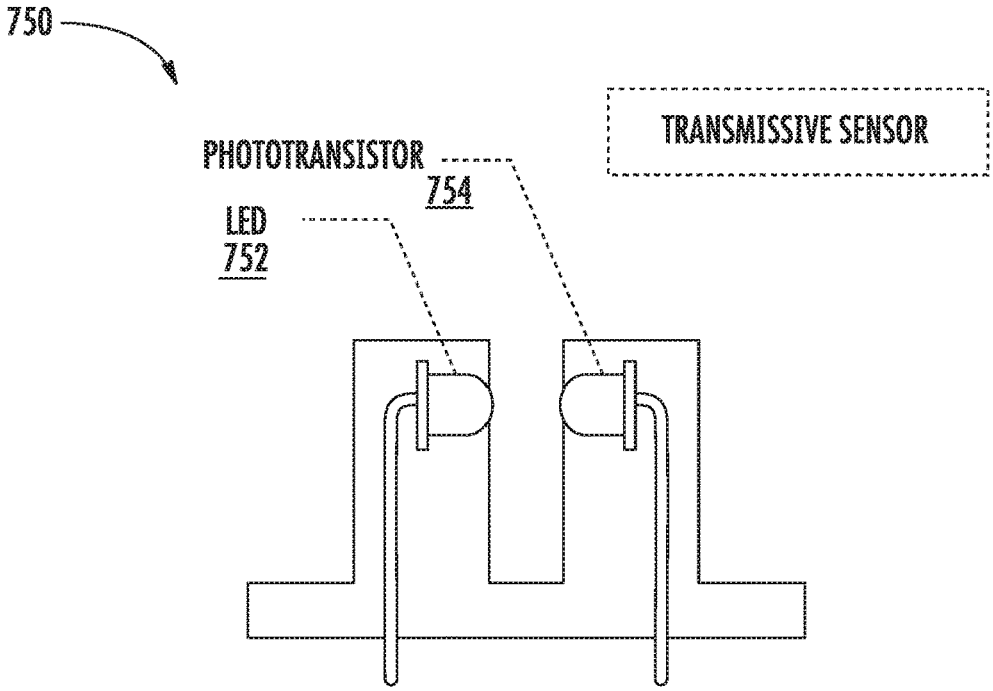
FIG. 7B illustrates an exemplary embodiment a transmissive sensor.

Transmissive sensors 606 may comprise an emitter (generally an InfraRed (IR) LED) and a receiver (generally an IR phototransistor), as illustrated in FIG. 7B, an exemplary embodiment of one of the transmissive sensors 606. The emitter (LED 752) is directly opposite and facing the receiver (phototransistor 754) and emits a beam of (infrared) light. In this embodiment, when there is no object placed between the emitter and the receiver, the emitted light may be sensed by the receiver that may generate a sensor signal, i.e., a high level signal that can be sent to a user. When there is obstruction between the emitter and the receiver, the receiver may not receive a light signal and may not generate any output signal, e.g., a low level signal. The obstruction may be the presence of one of the plurality of flaps 608. The "receiver" (phototransistor 754) may be referred to as a "light receiver). The "emitter" (LED 752) may be referred to as a "light emitter".

A high level signal may refer to a signal which has the same value as the sensor power voltage (usually written as VCC). A low level signal may refer to a signal close to the ground level (e.g., 0V) or with a value of −VCC, which is opposite the sensor power voltage. Example values may be a high level signal equals 5V (or 3.3V) and low level signal equals 0V.

FIG. 6B illustrates an exemplary embodiment 620 of the second solution of a media/ribbon hanger 622 shown with a first selection of moveable buttons 623 in a closed state and a second selection of moveable buttons 623 in an open state. FIG. 6B shows media/ribbon 624 loaded on media/ribbon hanger 622 causing the first selection of buttons to be in a closed state. The first selection of moveable buttons 623 is located directed below media/ribbon 624. The second selection of moveable buttons 623 is located immediately to the right of the first selection of button. Moveable button 627 is one of the second selection of moveable buttons 623.

Moveable button 625 is pressed down, by the weight of media/ribbon 624, causing corresponding flap 629 to be in a closed state. Similarly, moveable button 627 is not pressed down by roll of media/ribbon 624 allowing flap 628 to freely fall into an open state. When roll of media/ribbon 624 is loaded on media/ribbon hanger 522, one edge of the roll of media/ribbon 624 is positioned next to face 631 of the printer such that the media/ribbon 624 is pressing against face 631.

The transmissive sensors 626 may detect whether flap 628 and flap 629 is in an open state or a closed state. Based on that detection, the presence and width of the media or ribbon may be estimated. FIG. 7A illustrates an exemplary embodiment of reflective sensor 700. Reflective sensor 700 comprises LED 702, phototransistor 704. LED 702 may transmit a light signal (i.e., optical signal) that may be reflected off reflective surface 708. The reflected signal may be received by phototransistor 704 that may detect the light signal if the signal strength (i.e., light intensity) is sufficient to activate phototransistor 704. Reflective sensor 700 may be installed in mounting slot 706.

FIG. 7B illustrates an exemplary embodiment for a transmissive sensor 750. Transmissive sensor 750 comprises LED 752 and phototransistor 754. The operation of transmissive sensor 750 was previously discussed in regards to FIG. 6A and transmissive sensors 606.

Figure 8:
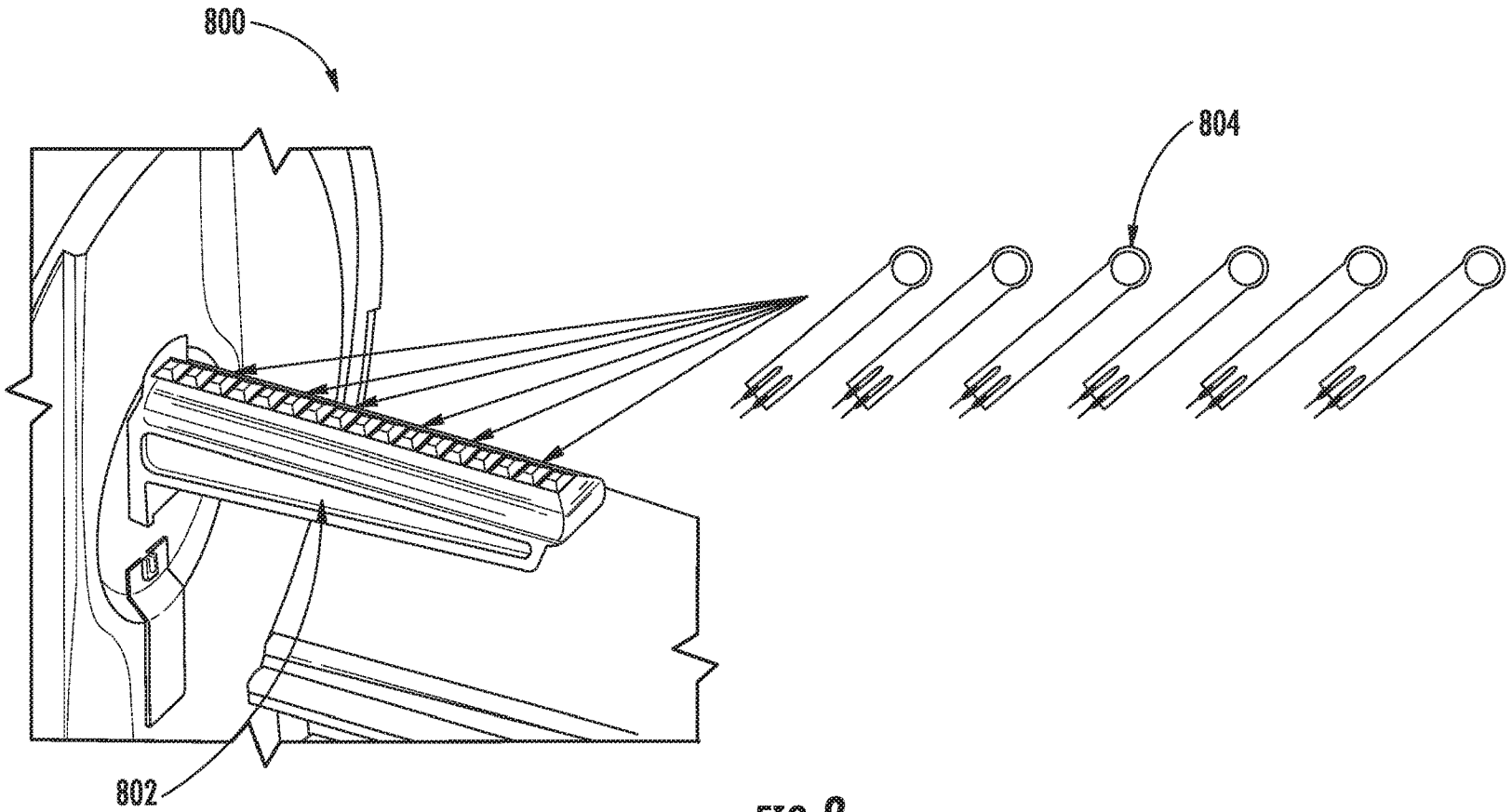
FIG. 8 illustrates an exemplary embodiment of a media/ribbon hanger with a feedback mechanism utilizing pressure sensors and a load force sensor that are used in a third solution.

FIG. 8 illustrates an exemplary embodiment 800 of media/ribbon hanger 802 with a feedback mechanism utilizing a plurality of pressure sensors 804, which are located on the top of media/ribbon hanger 802. With the use of the plurality of pressure sensors 804 and other components, the feedback mechanism of exemplary embodiment 800 is able to determine the weight of the media or ribbon loaded on the media/ribbon hanger 802. Knowledge of the weight may provide assistance to a user for detecting the amount of media or ribbon remaining in the media/ribbon hanger 802, including detecting if the media ribbon is depleted. Knowledge of the weight may also provide assistance to a user for print registration.

Figure 9:
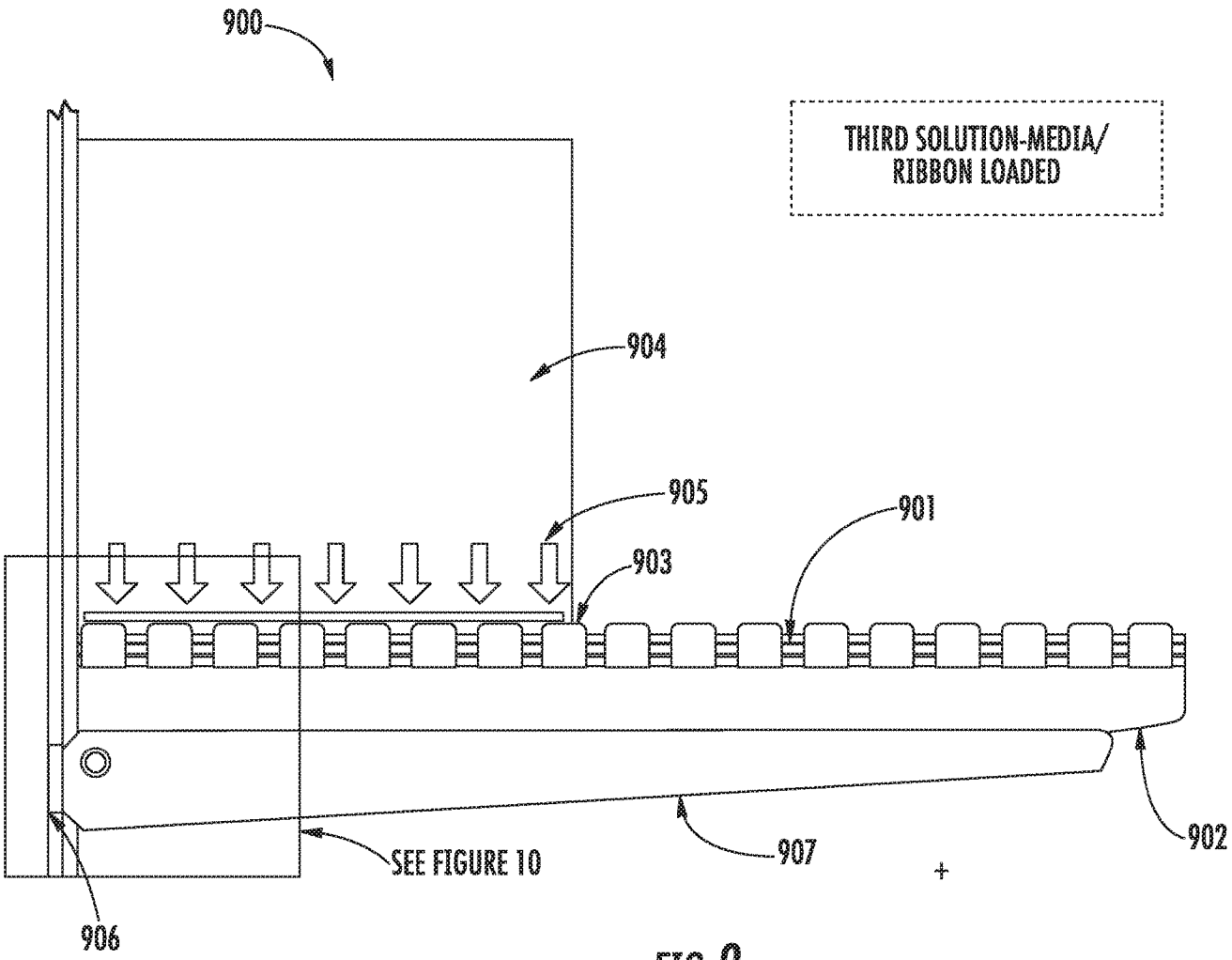
FIG. 9 illustrates an exemplary embodiment of the third solution of a media/ribbon hanger shown with media/ribbon loaded in the media/ribbon hanger.

FIG. 9 illustrates an exemplary embodiment 900 of the third solution of a media/ribbon hanger 902 shown with media/ribbon 904 loaded in the media/ribbon hanger 902. The media/ribbon hanger 902 comprises a plurality of pressure sensors 901, moveable buttons 903, load force sensor 906 and pivot bar 907. Pivot bar 907 is located on the bottom of media/ribbon hanger 902. Also shown on FIG. 9 are media/ribbon 904 and media force 905.

Figure 10:
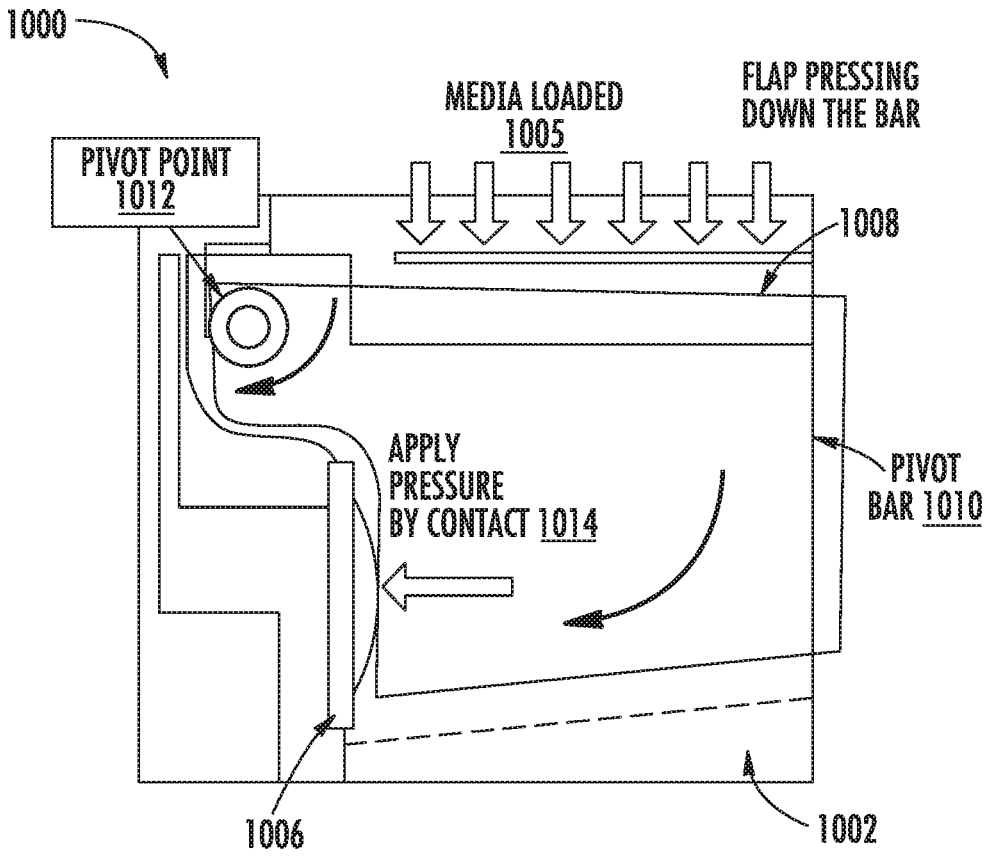
FIG. 10 illustrates an exemplary embodiment of the third solution showing pressure sensors installed in a media/ribbon hanger.

Referring to FIG. 9, the media/ribbon hanger 902 includes a pivot bar 907 which may work in tandem with a load force sensor 906. Whenever the media/ribbon hanger 902 is loaded with the media/ribbon 904, media force 905 may apply pressure to moveable button 903, which in turn exerts a pressure over the pivot bar 907, which may then be sensed by the load force sensor 906. The output of the load force sensor 906 can be calibrated to provide the feedback to the printer about status and availability of the media. The plurality of pressure sensors 901 may detect the width of the media/ribbon 904 that is loaded on media/ribbon hanger 902. The number or quantity of the plurality of pressure sensors 901 located on the media/ribbon hanger 902 determines the accuracy of the width detection FIG. 10 illustrates an exemplary embodiment 1000 of a portion of the feedback mechanism of the third solution showing pressure sensors 1008 installed in a media/ribbon hanger 1002. Also shown are media force 1005, load force sensor 1006, pivot bar 1010 and pivot point 1012 and pivot bar force 1014. The location of the components of FIG. 10 is noted on FIG. 9.

Per FIG. 10, media force 1005 presses down on pressure sensors 1008. Pressure sensors 1008 may cause pivot bar 1010 to "pivot" around pivot point 1012. This action in turn may cause pivot bar force 1014 to apply contact pressure on load force sensor 1006. From the change in contact pressure on load force sensor 1006 over time, the printer may determine the weight sensed and the status of the media/ribbon 904, included whether the media/ribbon 904 is depleted. Based on the determination of the weight sensed of the media/ribbon 904, the diameter of the roll of media/ribbon 904 may be determined. In other words, the diameter of the roll of media/ribbon 904 is proportional to the amount of contact pressure applied to the load force sensor 1006. In other words, the diameter of the roll of media or ribbon is proportional to an output of pressure applied to the load force sensor.

To summarize for the plurality of pressure sensors 901: As illustrated in FIG. 8, a plurality of pressure sensors 804 are distributed across the top of media/ribbon hanger 802. This aspect is also illustrated in FIG. 9, a plurality of pressure sensors 901 and a media/ribbon hanger 902. The plurality of pressure sensors 901 are able to detect information to allow the determination of 1) the presence of the roll of media/ribbon, 2) the weight of the roll of media, and subsequently the diameter/quantity available on the roll of media/ribbon, and 3) the width of the roll of media/ribbon. More sensors allow a more accuracy media width detection. The spacing and size of the sensors also impact the accuracy. Twelve smaller sensors would be more accurate than four sensors. However, if the twelve smaller sensors are arranged such that they are spaced apart in groups of three, the accuracy/resolution within the grouped region may improve, but if the end of the roll is between the groups the accuracy may not change.

To summarize for the load force sensor 906: The load force sensor 906 is illustrated FIG. 9. This aspect is also illustrated in load force sensor 1006 in FIG. 10. The load force sensor may detect information relative to 1) the presence of the roll of media/ribbon, 2) and if present detects, the weight of the roll of media, and subsequently, the diameter/quantity available on the roll of media/ribbon. The media/ribbon hanger provides a feedback message to a processor of the printer that then generates a message or alert for a user.

A determination of the number of labels remaining on the roll of media/ribbon 904 may be based on the pressure applied to the plurality of pressure sensors 901. The weight of the roll of media/ribbon 904 is proportional to the amount pressure applied to the plurality of the pressure sensors 901. A high pressure measurement indicates the roll of media/ribbon 904 is full. A low pressure measurement indicates the roll of media/ribbon 904 is low or empty. From a determination of the weight, the diameter of the roll of media/ribbon 904 may be determined.

For simple printer implementations, a processor of the printer provides a low media trigger signal when the diameter reaches a predefined threshold. Hence, a user receives an alert to indicate a low media status of the roll of media/ribbon.

For advanced implementations, the printer may determine the label length through Label Stop Sensor or media distance fed for continuous media. The printer monitors the pressure change over a period of time and determines the number labels printed in the same time period. Then, the printer may determine the amount of pressure caused by one label. The printer may determine the number of labels or the amount of distance of continuous ribbon or media that can still be printed with the remaining roll of media/ribbon 904.

In summary, referring to FIG. 9, based on the number of the plurality of pressure sensors 901 that detect the media force 905, the printer may determine the weight and width of the media/ribbon 904. The pressure sensor structure of FIG. 10 is noted in FIG. 9.

Figure 11:
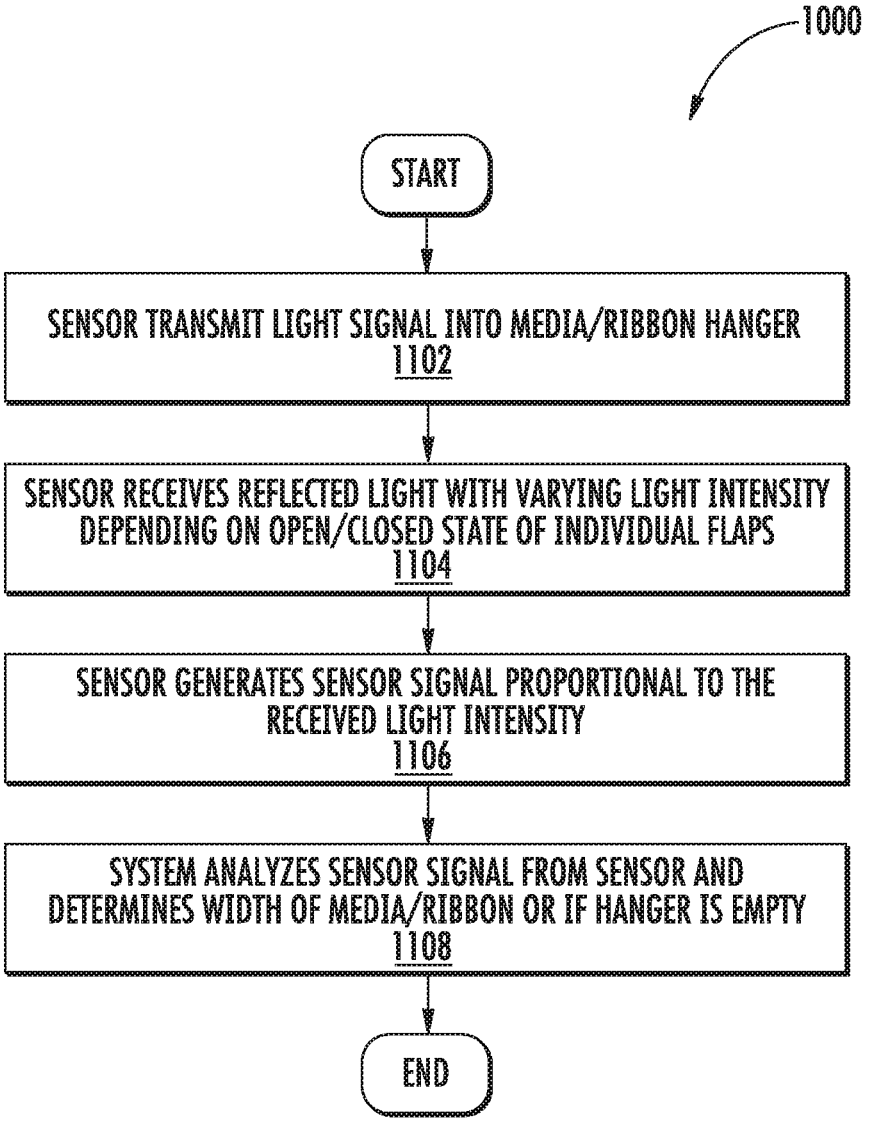
FIG. 11 illustrates an exemplary flowchart of a method to detect a roll of media/ribbon for the first solution.

FIG. 11 illustrates an exemplary flowchart 1100 of a method to detect the media/ribbon 524 for the first solution. The method comprises the steps described below. In these steps, references are made relative to elements of FIG. 5B including reflective sensor 526, a third light signal 530, a fourth light signal 532, flap 529 and media/ribbon hanger 522. The steps may also be described relative to elements of FIG. 5A including reflective sensor 506, first light signal 510, second light signal 512, flap 509 and media/ribbon hanger 502.

A method for a first solution may comprise the following steps:

Reflective sensor 526 transmits a third light signal 530 into media/ribbon hanger 522. (step 1102)

Reflective sensor 526 receives a fourth light signal 532. The third light signal 530 reflects on flap 528 to generate the fourth light signal 532. The fourth light signal 532 may have varying light intensity depending on open/closed state of individual flaps. Based on the light intensity of the fourth light signal 532, reflective sensor 526 emits (or transmits) a sensor signal to a system in a printer. (step 1104)

Reflective sensor 526 generates a sensor signal proportional to the received light intensity of the fourth light signal 532. The reflective sensor 526 communicates the sensor signal to a system in a printer. (step 1106)

The system analyzes sensor signal received from reflective sensor 526 and determines the width of media/ribbon or if hanger is empty. (step 1108)

Figure 12:
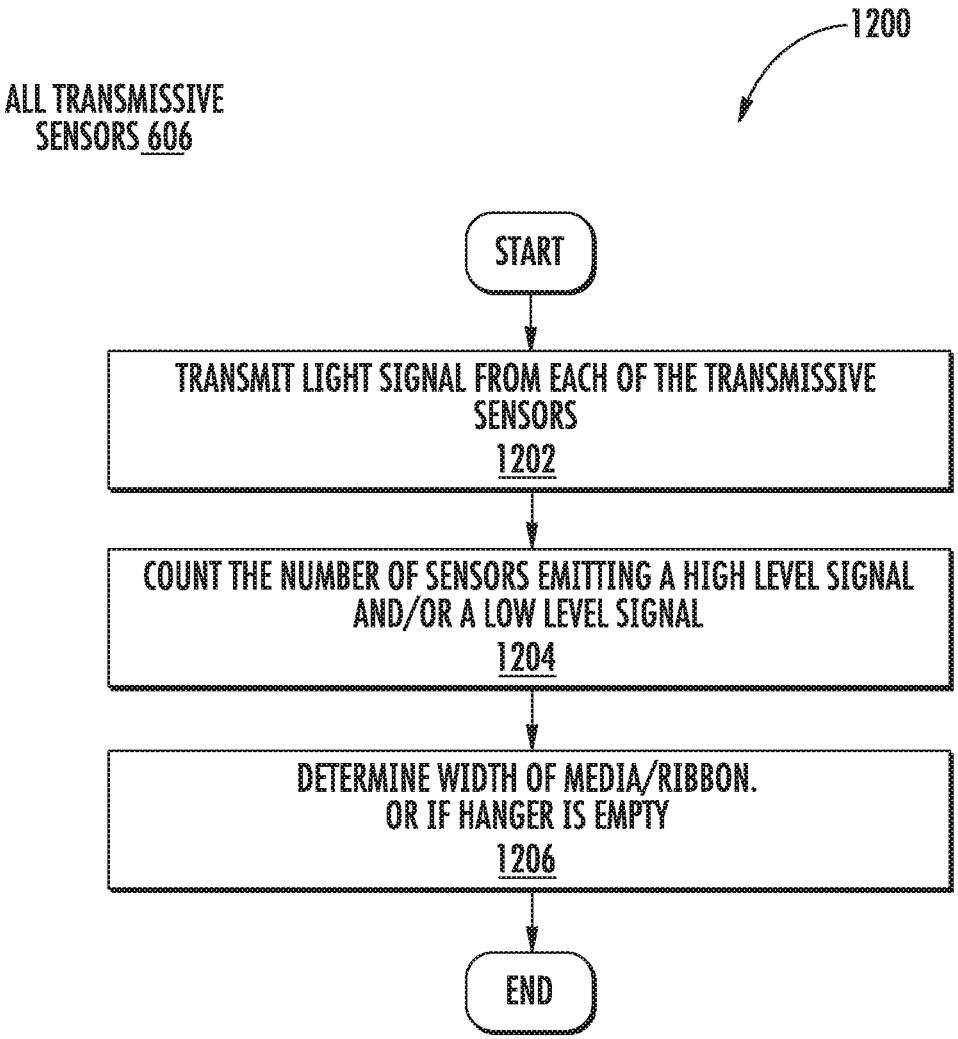
FIG. 12 illustrates an exemplary flowchart of a method to detect a roll media/ribbon for the second solution.

FIG. 12 illustrates an exemplary flowchart 1200 of a method to detect the media/ribbon 624 for the second solution. The method comprises the steps described below. In these steps, references are made relative to FIG. 6B, transmissive sensors 626, flap 529 and flap 529, and media/ribbon hanger 622. The steps may also be described relative to FIG. 6A, transmissive sensors 606, and media/ribbon hanger 602.

A method for a second solution may comprise the following steps:

Transmissive sensors 626 each transmits a light signal. (step 1202)

Transmissive sensors 626 may detect the presence of a particular flap, for example, flap 628 or flap 629. Based on this detection, transmissive sensors 626 may sense a high level signal or a low level signal. A system of the printer receives this information and counts the number transmissive sensors emitting a high level signal and/or low level signals. (step 1204)

Based on the count, determine a width of the media/ribbon 624, or determine if media/ribbon hanger 622 is empty. (step 1206)

Figure 13A:
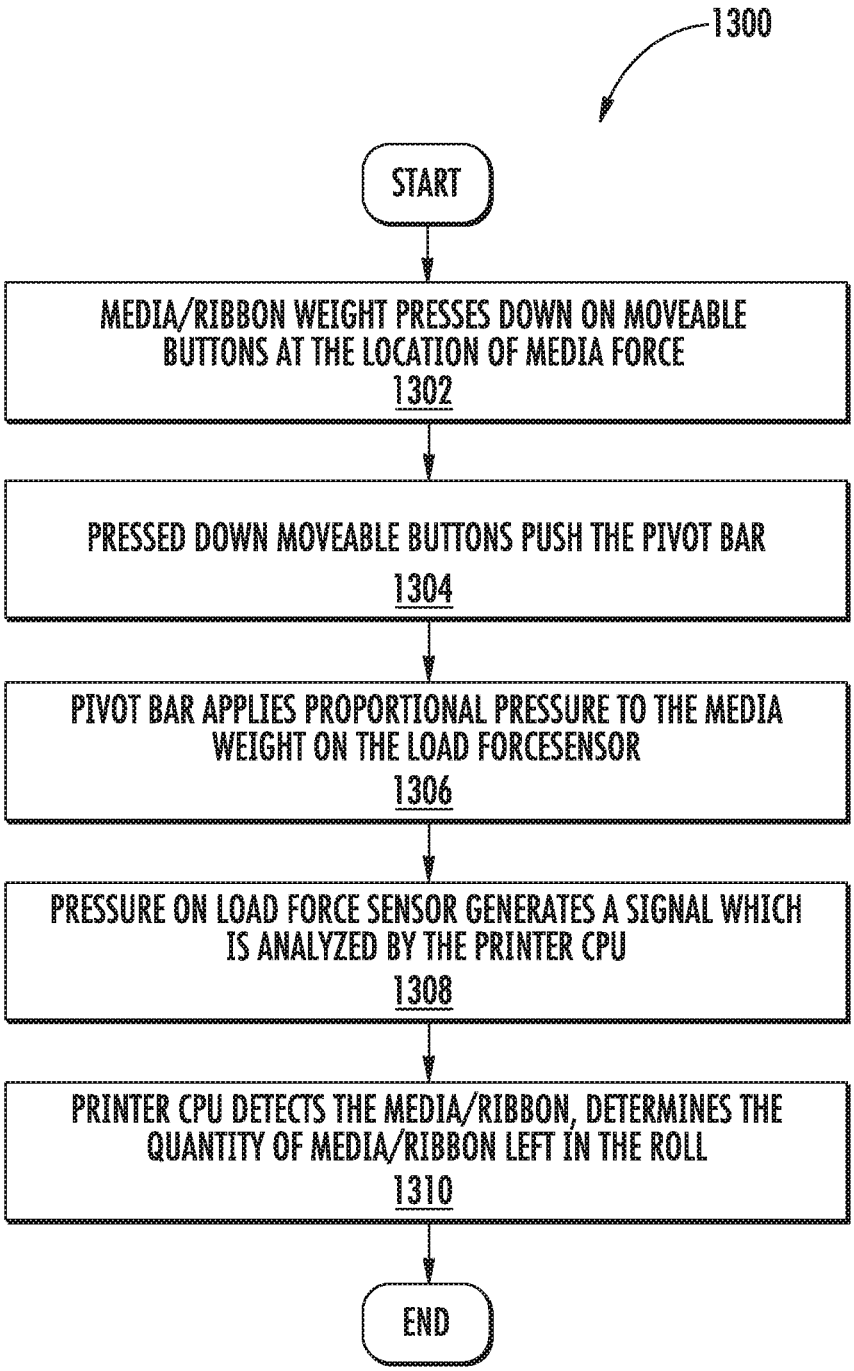
FIG. 13A illustrates an exemplary flowchart of a method to detect the media/ribbon for the third solution based on a load force sensor.

FIG. 13A illustrates an exemplary flowchart 1300 of a method to detect the media/ribbon 904 for the third solution based on load force sensor 906. The method may include determining the amount of media/ribbon left in the roll of media/ribbon. The method may comprise the steps described below. In these steps, references are made relative to FIG. 9.

A method for a third solution may comprise the following steps:

A roll of media/ribbon 904 weight presses down on moveable buttons 903 at the location of media force 905. (step 1302)

Pressed down moveable buttons 903 push the pivot bar 907. (step (step 1304)

Pivot bar 907 applies proportional pressure to the media weight on the load force sensor 906. Higher pressure may mean that the media/ribbon 904 is full. Lower pressure may mean that media/ribbon 904 is empty or depleted. (step 1306)

Pressure on load force sensor 906 generates a signal which is analyzed by a processor of the printer. More pressure may result in a higher level signal. (step 1308)

Printer CPU detects the media/ribbon 904, determines the quantity of media/ribbon 904 left in the roll. From the change in the amount of contact pressure on load force sensor 906 over time, the printer can determine the weight sensed and the status of the media/ribbon 904, included whether the media/ribbon 904 is depleted. The diameter of the roll of media/ribbon 904 may also be determined. (step 1310)

Figure 13B:
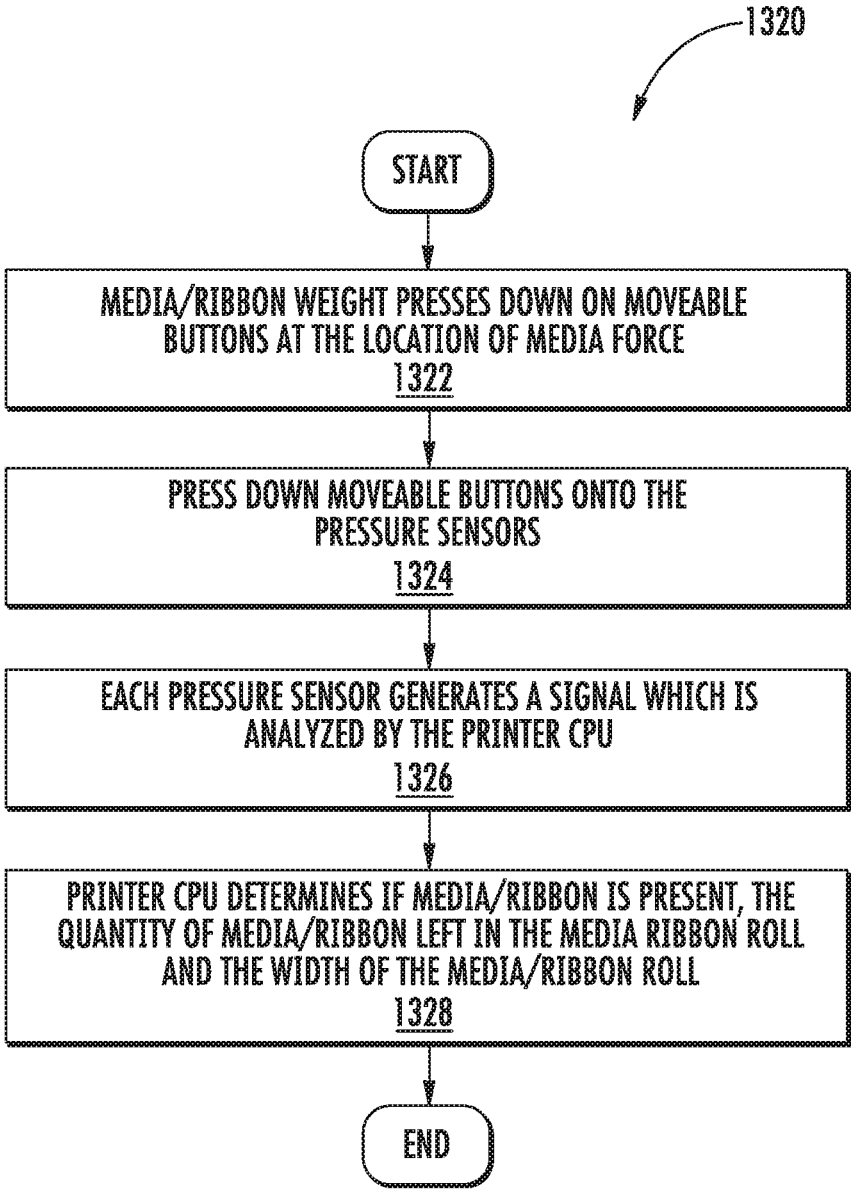
FIG. 13B illustrates an exemplary flowchart of a method to detect the media/ribbon for the third solution based on a plurality of pressure sensors.

FIG. 13B illustrates an exemplary flowchart 1320 of a method to detect the media/ribbon 904 for the third solution based on a plurality of pressure sensors 901. The method may include determining the amount of media/ribbon left in the roll of media/ribbon. The method may comprise the steps described below. In these steps, references are made relative to FIG. 9.

Another method for a third solution may comprise the following steps:

Media/ribbon weight presses down on moveable buttons 903 at the location of media force. (Step 1322)

Press down moveable buttons 903 onto the plurality of pressure sensors 901. (Step 1324)

Each pressure sensor generates a signal which is analyzed by the printer CPU. (Step 1326)

Printer CPU determines if media/ribbon is present, the quantity of media/ribbon left in the media/ribbon roll and the width of the roll of media/ribbon 904. (Step 1328)

FIG. 7A, reflective sensor 700, may comprise a time of flight (TOF) sensor, which is directed to the inside of the media hanger and directly in line with the flaps when they are in an open position. A TOF sensor may make use of the speed of light to calculate the distance to an object. The TOF sensor may emit a series of pulsed lights and may expect to receive the same series of pulsed light with a certain delay. The longer the delay, the further away the object is from the sensor. In this embodiment, the media may press down on the buttons, which may activate the flap to close to the respective width of the media. The sensor may then receive a different pulsed light with a defined delay depending on which flap is still open, and may make the determination of the media width by the printer.

A method utilizing a TOF sensor may comprise the following steps: (1) TOF emits pulsed light; (2) pulsed light is reflected by the first open flat back to the sensor; (3) TOF received pulsed light with a delay from the time it emitted the light; (4) the delay is translated to a distance measurement; and (5) printer defines the media width.

To supplement the present disclosure, this application incorporates entirely by reference the following commonly assigned patents, patent application publications, and patent applications:

U.S. Pat. Nos. 6,832,725; 7,128,266;
U.S. Pat. Nos. 7,159,783; 7,413,127;
U.S. Pat. Nos. 7,726,575; 8,294,969;
U.S. Pat. Nos. 8,317,105; 8,322,622;
U.S. Pat. Nos. 8,366,005; 8,371,507;
U.S. Pat. Nos. 8,376,233; 8,381,979;
U.S. Pat. Nos. 8,390,909; 8,408,464;
U.S. Pat. Nos. 8,408,468; 8,408,469;
U.S. Pat. Nos. 8,424,768; 8,448,863;
U.S. Pat. Nos. 8,457,013; 8,459,557;
U.S. Pat. Nos. 8,469,272; 8,474,712;
U.S. Pat. Nos. 8,479,992; 8,490,877;
U.S. Pat. Nos. 8,517,271; 8,523,076;
U.S. Pat. Nos. 8,528,818; 8,544,737;
U.S. Pat. Nos. 8,548,242; 8,548,420;
U.S. Pat. Nos. 8,550,335; 8,550,354;
U.S. Pat. Nos. 8,550,357; 8,556,174;

U.S. Pat. Nos. 8,556,176; 8,556,177;
U.S. Pat. Nos. 8,559,767; 8,599,957;
U.S. Pat. Nos. 8,561,895; 8,561,903;
U.S. Pat. Nos. 8,561,905; 8,565,107;
U.S. Pat. Nos. 8,571,307; 8,579,200;
U.S. Pat. Nos. 8,583,924; 8,584,945;
U.S. Pat. Nos. 8,587,595; 8,587,697;
U.S. Pat. Nos. 8,588,869; 8,590,789;
U.S. Pat. Nos. 8,596,539; 8,596,542;
U.S. Pat. Nos. 8,596,543; 8,599,271;
U.S. Pat. Nos. 8,599,957; 8,600,158;
U.S. Pat. Nos. 8,600,167; 8,602,309;
U.S. Pat. Nos. 8,608,053; 8,608,071;
U.S. Pat. Nos. 8,611,309; 8,615,487;
U.S. Pat. Nos. 8,616,454; 8,621,123;
U.S. Pat. Nos. 8,622,303; 8,628,013;
U.S. Pat. Nos. 8,628,015; 8,628,016;
U.S. Pat. Nos. 8,629,926; 8,630,491;
U.S. Pat. Nos. 8,635,309; 8,636,200;
U.S. Pat. Nos. 8,636,212; 8,636,215;
U.S. Pat. Nos. 8,636,224; 8,638,806;
U.S. Pat. Nos. 8,640,958; 8,640,960;
U.S. Pat. Nos. 8,643,717; 8,646,692;
U.S. Pat. Nos. 8,646,694; 8,657,200;
U.S. Pat. Nos. 8,659,397; 8,668,149;
U.S. Pat. Nos. 8,678,285; 8,678,286;
U.S. Pat. Nos. 8,682,077; 8,687,282;
U.S. Pat. Nos. 8,692,927; 8,695,880;
U.S. Pat. Nos. 8,698,949; 8,717,494;
U.S. Pat. Nos. 8,717,494; 8,720,783;
U.S. Pat. Nos. 8,723,804; 8,723,904;
U.S. Pat. Nos. 8,727,223; 8,740,082;
U.S. Pat. Nos. 8,740,085; 8,746,563;
U.S. Pat. Nos. 8,750,445; 8,752,766;
U.S. Pat. Nos. 8,756,059; 8,757,495;
U.S. Pat. Nos. 8,760,563; 8,763,909;
U.S. Pat. Nos. 8,777,108; 8,777,109;
U.S. Pat. Nos. 8,779,898; 8,781,520;
U.S. Pat. Nos. 8,783,573; 8,789,757;
U.S. Pat. Nos. 8,789,758; 8,789,759;
U.S. Pat. Nos. 8,794,520; 8,794,522;
U.S. Pat. Nos. 8,794,525; 8,794,526;
U.S. Pat. Nos. 8,798,367; 8,807,431;
U.S. Pat. Nos. 8,807,432; 8,820,630;
U.S. Pat. Nos. 8,822,848; 8,824,692;
U.S. Pat. Nos. 8,824,696; 8,842,849;
U.S. Pat. Nos. 8,844,822; 8,844,823;
U.S. Pat. Nos. 8,849,019; 8,851,383;
U.S. Pat. Nos. 8,854,633; 8,866,963;
U.S. Pat. Nos. 8,868,421; 8,868,519;
U.S. Pat. Nos. 8,868,802; 8,868,803;
U.S. Pat. Nos. 8,870,074; 8,879,639;
U.S. Pat. Nos. 8,880,426; 8,881,983;
U.S. Pat. Nos. 8,881,987; 8,903,172;
U.S. Pat. Nos. 8,908,995; 8,910,870;
U.S. Pat. Nos. 8,910,875; 8,914,290;
U.S. Pat. Nos. 8,914,788; 8,915,439;
U.S. Pat. Nos. 8,915,444; 8,916,789;
U.S. Pat. Nos. 8,918,250; 8,918,564;
U.S. Pat. Nos. 8,925,818; 8,939,374;
U.S. Pat. Nos. 8,942,480; 8,944,313;
U.S. Pat. Nos. 8,944,327; 8,944,332;
U.S. Pat. Nos. 8,950,678; 8,967,468;
U.S. Pat. Nos. 8,971,346; 8,976,030;
U.S. Pat. Nos. 8,976,368; 8,978,981;
U.S. Pat. Nos. 8,978,983; 8,978,984;
U.S. Pat. Nos. 8,985,456; 8,985,457;
U.S. Pat. Nos. 8,985,459; 8,985,461;
U.S. Pat. Nos. 8,988,578; 8,988,590;
U.S. Pat. Nos. 8,991,704; 8,996,194;
U.S. Pat. Nos. 8,996,384; 9,002,641;
U.S. Pat. Nos. 9,007,368; 9,010,641;
U.S. Pat. Nos. 9,015,513; 9,016,576;
U.S. Pat. Nos. 9,022,288; 9,030,964;
U.S. Pat. Nos. 9,033,240; 9,033,242;
U.S. Pat. Nos. 9,036,054; 9,037,344;
U.S. Pat. Nos. 9,038,911; 9,038,915;
U.S. Pat. Nos. 9,047,098; 9,047,359;
U.S. Pat. Nos. 9,047,420; 9,047,525;
U.S. Pat. Nos. 9,047,531; 9,053,055;
U.S. Pat. Nos. 9,053,378; 9,053,380;
U.S. Pat. Nos. 9,058,526; 9,064,165;
U.S. Pat. Nos. 9,064,165; 9,064,167;
U.S. Pat. Nos. 9,064,168; 9,064,254;
U.S. Pat. Nos. 9,066,032; 9,070,032;
U.S. Pat. Nos. 9,076,459; 9,079,423;
U.S. Pat. Nos. 9,080,856; 9,082,023;
U.S. Pat. Nos. 9,082,031; 9,084,032;
U.S. Pat. Nos. 9,087,250; 9,092,681;
U.S. Pat. Nos. 9,092,682; 9,092,683;
U.S. Pat. Nos. 9,093,141; 9,098,763;
U.S. Pat. Nos. 9,104,929; 9,104,934;
U.S. Pat. Nos. 9,107,484; 9,111,159;
U.S. Pat. Nos. 9,111,166; 9,135,483;
U.S. Pat. Nos. 9,137,009; 9,141,839;
U.S. Pat. Nos. 9,147,096; 9,148,474;
U.S. Pat. Nos. 9,158,000; 9,158,340;
U.S. Pat. Nos. 9,158,953; 9,159,059;
U.S. Pat. Nos. 9,165,174; 9,171,543;
U.S. Pat. Nos. 9,183,425; 9,189,669;
U.S. Pat. Nos. 9,195,844; 9,202,458;
U.S. Pat. Nos. 9,208,366; 9,208,367;
U.S. Pat. Nos. 9,219,836; 9,224,024;
U.S. Pat. Nos. 9,224,027; 9,230,140;
U.S. Pat. Nos. 9,235,553; 9,239,950;
U.S. Pat. Nos. 9,245,492; 9,248,640;
U.S. Pat. Nos. 9,250,652; 9,250,712;
U.S. Pat. Nos. 9,251,411; 9,258,033;
U.S. Pat. Nos. 9,262,633; 9,262,660;
U.S. Pat. Nos. 9,262,662; 9,269,036;
U.S. Pat. Nos. 9,270,782; 9,274,812;
U.S. Pat. Nos. 9,275,388; 9,277,668;
U.S. Pat. Nos. 9,280,693; 9,286,496;
U.S. Pat. Nos. 9,298,964; 9,301,427;
U.S. Pat. Nos. 9,313,377; 9,317,037;
U.S. Pat. Nos. 9,319,548; 9,342,723;
U.S. Pat. Nos. 9,361,882; 9,365,381;
U.S. Pat. Nos. 9,373,018; 9,375,945;
U.S. Pat. Nos. 9,378,403; 9,383,848;
U.S. Pat. Nos. 9,384,374; 9,390,304;
U.S. Pat. Nos. 9,390,596; 9,411,386;
U.S. Pat. Nos. 9,412,242; 9,418,269;
U.S. Pat. Nos. 9,418,270; 9,465,967;
U.S. Pat. Nos. 9,423,318; 9,424,454;
U.S. Pat. Nos. 9,436,860; 9,443,123;
U.S. Pat. Nos. 9,443,222; 9,454,689;
U.S. Pat. Nos. 9,464,885; 9,465,967;
U.S. Pat. Nos. 9,478,983; 9,481,186;
U.S. Pat. Nos. 9,487,113; 9,488,986;
U.S. Pat. Nos. 9,489,782; 9,490,540;
U.S. Pat. Nos. 9,491,729; 9,497,092;
U.S. Pat. Nos. 9,507,974; 9,519,814;
U.S. Pat. Nos. 9,521,331; 9,530,038;
U.S. Pat. Nos. 9,572,901; 9,558,386;

U.S. Pat. Nos. 9,606,581; 9,646,189;
U.S. Pat. Nos. 9,646,191; 9,652,648;
U.S. Pat. Nos. 9,652,653; 9,656,487;
U.S. Pat. Nos. 9,659,198; 9,680,282;
U.S. Pat. Nos. 9,697,401; 9,701,140;
U.S. Design Pat. No. D702,237;
U.S. Design Pat. No. D716,285;
U.S. Design Pat. No. D723,560;
U.S. Design Pat. No. D730,357;
U.S. Design Pat. No. D730,901;
U.S. Design Pat. No. D730,902;
U.S. Design Pat. No. D734,339;
U.S. Design Pat. No. D737,321;
U.S. Design Pat. No. D754,205;
U.S. Design Pat. No. D754,206;
U.S. Design Pat. No. D757,009;
U.S. Design Pat. No. D760,719;
U.S. Design Pat. No. D762,604;
U.S. Design Pat. No. D766,244;
U.S. Design Pat. No. D777,166;
U.S. Design Pat. No. D771,631;
U.S. Design Pat. No. D783,601;
U.S. Design Pat. No. D785,617;
U.S. Design Pat. No. D785,636;
U.S. Design Pat. No. D790,505;
U.S. Design Pat. No. D790,546;
International Publication No. 2013/163789;
U.S. Patent Application Publication No. 2008/0185432;
U.S. Patent Application Publication No. 2009/0134221;
U.S. Patent Application Publication No. 2010/0177080;
U.S. Patent Application Publication No. 2010/0177076;
U.S. Patent Application Publication No. 2010/0177707;
U.S. Patent Application Publication No. 2010/0177749;
U.S. Patent Application Publication No. 2010/0265880;
U.S. Patent Application Publication No. 2011/0202554;
U.S. Patent Application Publication No. 2012/0111946;
U.S. Patent Application Publication No. 2012/0168511;
U.S. Patent Application Publication No. 2012/0168512;
U.S. Patent Application Publication No. 2012/0193423;
U.S. Patent Application Publication No. 2012/0194692;
U.S. Patent Application Publication No. 2012/0203647;
U.S. Patent Application Publication No. 2012/0223141;
U.S. Patent Application Publication No. 2012/0228382;
U.S. Patent Application Publication No. 2012/0248188;
U.S. Patent Application Publication No. 2013/0043312;
U.S. Patent Application Publication No. 2013/0082104;
U.S. Patent Application Publication No. 2013/0175341;
U.S. Patent Application Publication No. 2013/0175343;
U.S. Patent Application Publication No. 2013/0257744;
U.S. Patent Application Publication No. 2013/0257759;
U.S. Patent Application Publication No. 2013/0270346;
U.S. Patent Application Publication No. 2013/0292475;
U.S. Patent Application Publication No. 2013/0292477;
U.S. Patent Application Publication No. 2013/0293539;
U.S. Patent Application Publication No. 2013/0293540;
U.S. Patent Application Publication No. 2013/0306728;
U.S. Patent Application Publication No. 2013/0306731;
U.S. Patent Application Publication No. 2013/0307964;
U.S. Patent Application Publication No. 2013/0308625;
U.S. Patent Application Publication No. 2013/0313324;
U.S. Patent Application Publication No. 2013/0332996;
U.S. Patent Application Publication No. 2014/0001267;
U.S. Patent Application Publication No. 2014/0025584;
U.S. Patent Application Publication No. 2014/0034734;
U.S. Patent Application Publication No. 2014/0036848;
U.S. Patent Application Publication No. 2014/0039693;
U.S. Patent Application Publication No. 2014/0049120;
U.S. Patent Application Publication No. 2014/0049635;
U.S. Patent Application Publication No. 2014/0061306;
U.S. Patent Application Publication No. 2014/0063289;
U.S. Patent Application Publication No. 2014/0066136;
U.S. Patent Application Publication No. 2014/0067692;
U.S. Patent Application Publication No. 2014/0070005;
U.S. Patent Application Publication No. 2014/0071840;
U.S. Patent Application Publication No. 2014/0074746;
U.S. Patent Application Publication No. 2014/0076974;
U.S. Patent Application Publication No. 2014/0097249;
U.S. Patent Application Publication No. 2014/0098792;
U.S. Patent Application Publication No. 2014/0100813;
U.S. Patent Application Publication No. 2014/0103115;
U.S. Patent Application Publication No. 2014/0104413;
U.S. Patent Application Publication No. 2014/0104414;
U.S. Patent Application Publication No. 2014/0104416;
U.S. Patent Application Publication No. 2014/0106725;
U.S. Patent Application Publication No. 2014/0108010;
U.S. Patent Application Publication No. 2014/0108402;
U.S. Patent Application Publication No. 2014/0110485;
U.S. Patent Application Publication No. 2014/0125853;
U.S. Patent Application Publication No. 2014/0125999;
U.S. Patent Application Publication No. 2014/0129378;
U.S. Patent Application Publication No. 2014/0131443;
U.S. Patent Application Publication No. 2014/0133379;
U.S. Patent Application Publication No. 2014/0136208;
U.S. Patent Application Publication No. 2014/0140585;
U.S. Patent Application Publication No. 2014/0152882;
U.S. Patent Application Publication No. 2014/0158770;
U.S. Patent Application Publication No. 2014/0159869;
U.S. Patent Application Publication No. 2014/0166759;
U.S. Patent Application Publication No. 2014/0168787;
U.S. Patent Application Publication No. 2014/0175165;
U.S. Patent Application Publication No. 2014/0191684;
U.S. Patent Application Publication No. 2014/0191913;
U.S. Patent Application Publication No. 2014/0197304;
U.S. Patent Application Publication No. 2014/0214631;
U.S. Patent Application Publication No. 2014/0217166;
U.S. Patent Application Publication No. 2014/0231500;
U.S. Patent Application Publication No. 2014/0247315;
U.S. Patent Application Publication No. 2014/0263493;
U.S. Patent Application Publication No. 2014/0263645;
U.S. Patent Application Publication No. 2014/0270196;
U.S. Patent Application Publication No. 2014/0270229;
U.S. Patent Application Publication No. 2014/0278387;
U.S. Patent Application Publication No. 2014/0288933;
U.S. Patent Application Publication No. 2014/0297058;
U.S. Patent Application Publication No. 2014/0299665;
U.S. Patent Application Publication No. 2014/0332590;
U.S. Patent Application Publication No. 2014/0351317;
U.S. Patent Application Publication No. 2014/0362184;
U.S. Patent Application Publication No. 2014/0363015;
U.S. Patent Application Publication No. 2014/0369511;
U.S. Patent Application Publication No. 2014/0374483;
U.S. Patent Application Publication No. 2014/0374485;
U.S. Patent Application Publication No. 2015/0001301;
U.S. Patent Application Publication No. 2015/0001304;
U.S. Patent Application Publication No. 2015/0009338;
U.S. Patent Application Publication No. 2015/0014416;
U.S. Patent Application Publication No. 2015/0021397;
U.S. Patent Application Publication No. 2015/0028104;
U.S. Patent Application Publication No. 2015/0029002;
U.S. Patent Application Publication No. 2015/0032709;
U.S. Patent Application Publication No. 2015/0039309;
U.S. Patent Application Publication No. 2015/0039878;
U.S. Patent Application Publication No. 2015/0040378;
U.S. Patent Application Publication No. 2015/0049347;

U.S. Patent Application Publication No. 2015/0051992;
U.S. Patent Application Publication No. 2015/0053769;
U.S. Patent Application Publication No. 2015/0062366;
U.S. Patent Application Publication No. 2015/0063215;
U.S. Patent Application Publication No. 2015/0088522;
U.S. Patent Application Publication No. 2015/0096872;
U.S. Patent Application Publication No. 2015/0100196;
U.S. Patent Application Publication No. 2015/0102109;
U.S. Patent Application Publication No. 2015/0115035;
U.S. Patent Application Publication No. 2015/0127791;
U.S. Patent Application Publication No. 2015/0128116;
U.S. Patent Application Publication No. 2015/0133047;
U.S. Patent Application Publication No. 2015/0134470;
U.S. Patent Application Publication No. 2015/0136851;
U.S. Patent Application Publication No. 2015/0142492;
U.S. Patent Application Publication No. 2015/0144692;
U.S. Patent Application Publication No. 2015/0144698;
U.S. Patent Application Publication No. 2015/0149946;
U.S. Patent Application Publication No. 2015/0161429;
U.S. Patent Application Publication No. 2015/0178523;
U.S. Patent Application Publication No. 2015/0178537;
U.S. Patent Application Publication No. 2015/0178685;
U.S. Patent Application Publication No. 2015/0181109;
U.S. Patent Application Publication No. 2015/0199957;
U.S. Patent Application Publication No. 2015/0210199;
U.S. Patent Application Publication No. 2015/0212565;
U.S. Patent Application Publication No. 2015/0213647;
U.S. Patent Application Publication No. 2015/0220753;
U.S. Patent Application Publication No. 2015/0220901;
U.S. Patent Application Publication No. 2015/0227189;
U.S. Patent Application Publication No. 2015/0236984;
U.S. Patent Application Publication No. 2015/0239348;
U.S. Patent Application Publication No. 2015/0242658;
U.S. Patent Application Publication No. 2015/0248572;
U.S. Patent Application Publication No. 2015/0254485;
U.S. Patent Application Publication No. 2015/0261643;
U.S. Patent Application Publication No. 2015/0264624;
U.S. Patent Application Publication No. 2015/0268971;
U.S. Patent Application Publication No. 2015/0269402;
U.S. Patent Application Publication No. 2015/0288689;
U.S. Patent Application Publication No. 2015/0288896;
U.S. Patent Application Publication No. 2015/0310243;
U.S. Patent Application Publication No. 2015/0310244;
U.S. Patent Application Publication No. 2015/0310389;
U.S. Patent Application Publication No. 2015/0312780;
U.S. Patent Application Publication No. 2015/0327012;
U.S. Patent Application Publication No. 2016/0014251;
U.S. Patent Application Publication No. 2016/0025697;
U.S. Patent Application Publication No. 2016/0026838;
U.S. Patent Application Publication No. 2016/0026839;
U.S. Patent Application Publication No. 2016/0040982;
U.S. Patent Application Publication No. 2016/0042241;
U.S. Patent Application Publication No. 2016/0057230;
U.S. Patent Application Publication No. 2016/0062473;
U.S. Patent Application Publication No. 2016/0070944;
U.S. Patent Application Publication No. 2016/0092805;
U.S. Patent Application Publication No. 2016/0101936;
U.S. Patent Application Publication No. 2016/0104019;
U.S. Patent Application Publication No. 2016/0104274;
U.S. Patent Application Publication No. 2016/0109219;
U.S. Patent Application Publication No. 2016/0109220;
U.S. Patent Application Publication No. 2016/0109224;
U.S. Patent Application Publication No. 2016/0112631;
U.S. Patent Application Publication No. 2016/0112643;
U.S. Patent Application Publication No. 2016/0117627;
U.S. Patent Application Publication No. 2016/0124516;
U.S. Patent Application Publication No. 2016/0125217;
U.S. Patent Application Publication No. 2016/0125342;
U.S. Patent Application Publication No. 2016/0125873;
U.S. Patent Application Publication No. 2016/0133253;
U.S. Patent Application Publication No. 2016/0171597;
U.S. Patent Application Publication No. 2016/0171666;
U.S. Patent Application Publication No. 2016/0171720;
U.S. Patent Application Publication No. 2016/0171775;
U.S. Patent Application Publication No. 2016/0171777;
U.S. Patent Application Publication No. 2016/0174674;
U.S. Patent Application Publication No. 2016/0178479;
U.S. Patent Application Publication No. 2016/0178685;
U.S. Patent Application Publication No. 2016/0178707;
U.S. Patent Application Publication No. 2016/0179132;
U.S. Patent Application Publication No. 2016/0179143;
U.S. Patent Application Publication No. 2016/0179368;
U.S. Patent Application Publication No. 2016/0179378;
U.S. Patent Application Publication No. 2016/0180130;
U.S. Patent Application Publication No. 2016/0180133;
U.S. Patent Application Publication No. 2016/0180136;
U.S. Patent Application Publication No. 2016/0180594;
U.S. Patent Application Publication No. 2016/0180663;
U.S. Patent Application Publication No. 2016/0180678;
U.S. Patent Application Publication No. 2016/0180713;
U.S. Patent Application Publication No. 2016/0185136;
U.S. Patent Application Publication No. 2016/0185291;
U.S. Patent Application Publication No. 2016/0186926;
U.S. Patent Application Publication No. 2016/0188861;
U.S. Patent Application Publication No. 2016/0188939;
U.S. Patent Application Publication No. 2016/0188940;
U.S. Patent Application Publication No. 2016/0188941;
U.S. Patent Application Publication No. 2016/0188942;
U.S. Patent Application Publication No. 2016/0188943;
U.S. Patent Application Publication No. 2016/0188944;
U.S. Patent Application Publication No. 2016/0189076;
U.S. Patent Application Publication No. 2016/0189087;
U.S. Patent Application Publication No. 2016/0189088;
U.S. Patent Application Publication No. 2016/0189092;
U.S. Patent Application Publication No. 2016/0189284;
U.S. Patent Application Publication No. 2016/0189288;
U.S. Patent Application Publication No. 2016/0189366;
U.S. Patent Application Publication No. 2016/0189443;
U.S. Patent Application Publication No. 2016/0189447;
U.S. Patent Application Publication No. 2016/0189489;
U.S. Patent Application Publication No. 2016/0192051;
U.S. Patent Application Publication No. 2016/0202951;
U.S. Patent Application Publication No. 2016/0202958;
U.S. Patent Application Publication No. 2016/0202959;
U.S. Patent Application Publication No. 2016/0203021;
U.S. Patent Application Publication No. 2016/0203429;
U.S. Patent Application Publication No. 2016/0203797;
U.S. Patent Application Publication No. 2016/0203820;
U.S. Patent Application Publication No. 2016/0204623;
U.S. Patent Application Publication No. 2016/0204636;
U.S. Patent Application Publication No. 2016/0204638;
U.S. Patent Application Publication No. 2016/0227912;
U.S. Patent Application Publication No. 2016/0232891;
U.S. Patent Application Publication No. 2016/0292477;
U.S. Patent Application Publication No. 2016/0294779;
U.S. Patent Application Publication No. 2016/0306769;
U.S. Patent Application Publication No. 2016/0314276;
U.S. Patent Application Publication No. 2016/0314294;
U.S. Patent Application Publication No. 2016/0316190;
U.S. Patent Application Publication No. 2016/0323310;
U.S. Patent Application Publication No. 2016/0325677;
U.S. Patent Application Publication No. 2016/0327614;
U.S. Patent Application Publication No. 2016/0327930;
U.S. Patent Application Publication No. 2016/0328762;

U.S. Patent Application Publication No. 2016/0330218;
U.S. Patent Application Publication No. 2016/0343163;
U.S. Patent Application Publication No. 2016/0343176;
U.S. Patent Application Publication No. 2016/0364914;
U.S. Patent Application Publication No. 2016/0370220;
U.S. Patent Application Publication No. 2016/0372282;
U.S. Patent Application Publication No. 2016/0373847;
U.S. Patent Application Publication No. 2016/0377414;
U.S. Patent Application Publication No. 2016/0377417;
U.S. Patent Application Publication No. 2017/0010141;
U.S. Patent Application Publication No. 2017/0010328;
U.S. Patent Application Publication No. 2017/0010780;
U.S. Patent Application Publication No. 2017/0016714;
U.S. Patent Application Publication No. 2017/0018094;
U.S. Patent Application Publication No. 2017/0046603;
U.S. Patent Application Publication No. 2017/0047864;
U.S. Patent Application Publication No. 2017/0053146;
U.S. Patent Application Publication No. 2017/0053147;
U.S. Patent Application Publication No. 2017/0053647;
U.S. Patent Application Publication No. 2017/0055606;
U.S. Patent Application Publication No. 2017/0060316;
U.S. Patent Application Publication No. 2017/0061961;
U.S. Patent Application Publication No. 2017/0064634;
U.S. Patent Application Publication No. 2017/0083730;
U.S. Patent Application Publication No. 2017/0091502;
U.S. Patent Application Publication No. 2017/0091706;
U.S. Patent Application Publication No. 2017/0091741;
U.S. Patent Application Publication No. 2017/0091904;
U.S. Patent Application Publication No. 2017/0092908;
U.S. Patent Application Publication No. 2017/0094238;
U.S. Patent Application Publication No. 2017/0098947;
U.S. Patent Application Publication No. 2017/0100949;
U.S. Patent Application Publication No. 2017/0108838;
U.S. Patent Application Publication No. 2017/0108895;
U.S. Patent Application Publication No. 2017/0118355;
U.S. Patent Application Publication No. 2017/0123598;
U.S. Patent Application Publication No. 2017/0124369;
U.S. Patent Application Publication No. 2017/0124396;
U.S. Patent Application Publication No. 2017/0124687;
U.S. Patent Application Publication No. 2017/0126873;
U.S. Patent Application Publication No. 2017/0126904;
U.S. Patent Application Publication No. 2017/0139012;
U.S. Patent Application Publication No. 2017/0140329;
U.S. Patent Application Publication No. 2017/0140731;
U.S. Patent Application Publication No. 2017/0147847;
U.S. Patent Application Publication No. 2017/0150124;
U.S. Patent Application Publication No. 2017/0169198;
U.S. Patent Application Publication No. 2017/0171035;
U.S. Patent Application Publication No. 2017/0171703;
U.S. Patent Application Publication No. 2017/0171803;
U.S. Patent Application Publication No. 2017/0180359;
U.S. Patent Application Publication No. 2017/0180577;
U.S. Patent Application Publication No. 2017/0181299;
U.S. Patent Application Publication No. 2017/0190192;
U.S. Patent Application Publication No. 2017/0193432;
U.S. Patent Application Publication No. 2017/0193461;
U.S. Patent Application Publication No. 2017/0193727;
U.S. Patent Application Publication No. 2017/0199266;
U.S. Patent Application Publication No. 2017/0200108; and
U.S. Patent Application Publication No. 2017/0200275.

In the specification and/or figures, typical embodiments of the invention have been disclosed. The present invention is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The invention claimed is:

1. A printer comprising:

a housing;

a hanger having a top surface and open portion below the top surface;

a plurality of moveable buttons located on a top of the hanger;

a plurality of flaps located below the top surface of the hanger, wherein each of the plurality of flaps is associated with a corresponding one of the plurality of moveable buttons;

each of the plurality of flaps being in an open state or a closed state based on a position of a roll of media or ribbon loaded on the hanger;

one or more sensors that determine a state of at least one of the plurality of flaps and output at least one signal corresponding to the state; and a processor for processing the at least one output signal to determine at least one of a presence of the roll of media or ribbon loaded on the hanger and a width of the roll of media or ribbon loaded on the hanger.

2. The printer as in claim 1, wherein, the one or more sensors comprise a reflective sensor.

3. The printer as in claim 2, wherein, the reflective sensor transmits a first light signal through the open portion of the hanger, wherein, the first light signal reflects off a first flap in the open state causing a generation of a second light signal.

4. The printer as in claim 3, wherein, the reflective sensor receives the second light signal with a different light intensity, depending on a location of the first flap, allowing a determination of a status of the roll of media or ribbon loaded on the hanger.

5. The printer as in claim 3, wherein, the reflective sensor receives the second light signal, and based on a measured time of flight determines if the media or ribbon is loaded on the hanger and/or determines the width of the media or ribbon loaded on the hanger.

6. The printer as in claim 2, wherein, the reflective sensor is located at one end of the hanger.

7. The printer as in claim 1, wherein, if the roll of media or ribbon is not loaded on the hanger, the plurality of moveable buttons does not engage the plurality of flaps causing the open state for the plurality of flaps.

8. The printer as in claim 1, wherein, if the roll of media or ribbon is loaded on the hanger, the plurality of moveable buttons underneath the roll of media or ribbon engage a corresponding plurality of flaps causing the closed state for the plurality of corresponding flaps.

9. The printer as in claim 1, wherein, the one or more sensors comprise a plurality of transmissive sensors, wherein, each transmissive sensor includes a light emitter and a light receiver.

10. The printer as in claim 9, wherein, each of the plurality of transmissive sensors transmits a light signal via the light emitter, and wherein, if the light signal of each of the plurality of transmissive sensors is in proximity to one of the plurality of flaps in an open condition, then each of a plurality of light receivers do not receive the light signal from the light emitter and generate a first signal, if the light signal of each of the plurality of transmissive sensors is in proximity of the one of the plurality of flaps in a closed condition, then the each of the plurality of light receivers receive the light signal from the light emitter and generate a second signal.

11. The printer as in claim 10, wherein, a number of first or second signals received by the plurality of transmissive sensors determines at least one of the presence and width of the roll of media or ribbon.

* * * * *